US010463562B2

(12) United States Patent
Chavarria et al.

(10) Patent No.: US 10,463,562 B2
(45) Date of Patent: Nov. 5, 2019

(54) ADJUSTABLE TRUNK AND HIP ASSEMBLY FOR EXOSKELETON APPARATUS

(71) Applicant: U.S. Bionics, Inc., Emeryville, CA (US)

(72) Inventors: Jose Chavarria, Oakland, CA (US); Michael McKinley, Berkeley, CA (US); Yoon Jeong, Berkeley, CA (US); Raghid Mardini, Berkeley, CA (US)

(73) Assignee: U.S. BIONICS, INC., Emeryville, CA (US)

( * ) Notice: Subject to any disclaimer, the term of this patent is extended or adjusted under 35 U.S.C. 154(b) by 0 days.

(21) Appl. No.: 15/990,434

(22) Filed: May 25, 2018

(65) Prior Publication Data

US 2018/0338883 A1 Nov. 29, 2018

Related U.S. Application Data

(60) Provisional application No. 62/510,753, filed on May 25, 2017.

(51) Int. Cl.
*A61H 3/00* (2006.01)

(52) U.S. Cl.
CPC ..... *A61H 3/00* (2013.01); *A61H 2201/1215* (2013.01); *A61H 2201/1418* (2013.01);
(Continued)

(58) Field of Classification Search
CPC ..... A61H 3/00; A61H 2201/1418; A61H 2201/1215; A61H 2201/5007;
(Continued)

(56) References Cited

U.S. PATENT DOCUMENTS

2014/0378882 A1* 12/2014 Kazerooni ..... A61F 5/01 602/19
2015/0025423 A1* 1/2015 Caires ..... A61H 1/024 601/35

(Continued)

FOREIGN PATENT DOCUMENTS

WO 2018218228 A1 11/2018

OTHER PUBLICATIONS

EksoVest Operator Manual, Ekso Bionics, Inc., Feb. 2018, 29 pages.

(Continued)

*Primary Examiner* — Quang D Thanh
(74) *Attorney, Agent, or Firm* — Kwan & Olynick LLP

(57) ABSTRACT

Provided is an exoskeleton assembly configured to be coupled to a wearer, including a plurality of members corresponding to body segments of the wearer. An adjustable first member includes a first component and a second component. The assembly further includes a first locking mechanism and a second locking mechanism, each configured to alternate between a locked position and unlocked position. When the first locking mechanism and the second locking mechanism are in the respective unlocked positions, the first component and the second component are free to slide relative to each other thereby adjusting the length of the first member. When either the first locking mechanism or the second locking mechanism is in the respective locked position, the first component and the second component are not free to slide relative to each other. The first member may be a spine assembly, a hip assembly, or a leg assembly.

30 Claims, 32 Drawing Sheets

(52) U.S. Cl.
CPC .. *A61H 2201/164* (2013.01); *A61H 2201/165* (2013.01); *A61H 2201/168* (2013.01); *A61H 2201/1614* (2013.01); *A61H 2201/1623* (2013.01); *A61H 2201/1628* (2013.01); *A61H 2201/5007* (2013.01); *A61H 2201/5043* (2013.01)

(58) Field of Classification Search
CPC ..... A61H 2201/164; A61H 2201/5043; A61H 2201/1623; A61H 2201/168; A61H 2201/1614; A61H 2201/1628
See application file for complete search history.

(56) References Cited

U.S. PATENT DOCUMENTS

| | | | | |
|---|---|---|---|---|
| 2015/0230964 | A1* | 8/2015 | Kazerooni | A61F 5/02 602/16 |
| 2016/0030272 | A1* | 2/2016 | Angold | A61H 1/024 623/24 |
| 2016/0206498 | A1* | 7/2016 | Kazerooni | A61F 5/028 |

OTHER PUBLICATIONS

Hugh Herr, "Exoskeletons and Orthoses: Classification, Design Challenges and Future Directions," *Journal of NeuroEngineering and Rehabilitation* 2009, 6:21, 10 pages.

Allan B. Cass, "Preliminary Specifications for an Exoskeleton for the Training of Balance in Balance Impaired Individuals," Thesis submitted to the Faculty of the Virginia Polytechnic Institute and State University, Aug. 27, 2008, 79 pages.

* cited by examiner

ADJUSTABLE TRUNK AND HIP ASSEMBLY FOR EXOSKELETON APPARATUS

CROSS REFERENCE TO RELATED APPLICATIONS

This application claims priority under 35 U.S.C. § 119(e) to U.S. Provisional Application No. 62/510,753, filed May 25, 2017, entitled ADJUSTABLE TRUNK AND HIP ASSEMBLY FOR EXOSKELETON APPARATUS, the contents of each of which are hereby incorporated by reference.

TECHNICAL FIELD

The present disclosure relates generally to orthesis systems, and more specifically to exoskeletons to be used by people with mobility disorders.

DESCRIPTION OF RELATED ART

Patients who have difficulty walking often use wheelchairs for mobility. It is a common and well-respected opinion in the field that postponing the use of wheelchairs will retard the onset of other types of secondary disabilities and diseases. The ramifications of long-term wheelchair use are secondary injuries to the body including hip, knee, and ankle contractures, heterotopic ossification of lower extremity joints, frequent urinary tract infection, spasticity, and reduced heart and circulatory function. These injuries must be treated with hospital care, medications, and several surgical procedures. In a 25-30 year treatment program, the average cost of treatment to one paraplegic patient is approximately $750,000, a heavy burden on both the patient and healthcare resources. Physicians strongly advocate the idea that it is essential for patients to forgo the use of wheelchairs and remain upright and mobile as much as possible.

Devices, such as powered exoskeletons, can be used to restore mobility and upright posture, and delay or substitute the use of wheelchairs. However existing exoskeletons have shortcomings. Therefore, there is a need for an improved exoskeleton, and in particular, mounting mechanisms for securing the exoskeleton device to the user.

SUMMARY

The following presents a simplified summary of the disclosure in order to provide a basic understanding of certain embodiments of the disclosure. This summary is not an extensive overview of the disclosure and it does not identify key/critical elements of the disclosure or delineate the scope of the disclosure. Its sole purpose is to present some concepts disclosed herein in a simplified form as a prelude to the more detailed description that is presented later.

In general, certain embodiments of the present disclosure provide a trunk and hip assembly for an exoskeleton apparatus. The exoskeleton assembly comprises an adjustable spine, which comprises a base portion and a shoulder brace slidably coupled to the base portion. The exoskeleton assembly further comprises a first locking mechanism configured to alternate between a first locked position and a first unlocked position, and a second locking mechanism configured to alternate between a second locked position and a second unlocked position. When the first locking mechanism is in the first unlocked position and the second locking mechanism is in the second unlocked position, the shoulder brace and base portion are free to slide relative to each other thereby adjusting the length of the adjustable spine. When either the first locking mechanism is in the first locked position or the second locking mechanism is in the second locked position, the shoulder brace and the base portion are not free to slide relative to each other.

The adjustable spine may be configured to be positioned substantially behind a wearer and substantially parallel to the spine of the wearer.

The first locking mechanism may comprise at least one spine indexing pin coupled to the base portion, and a set of notches coupled to the shoulder brace. When the first locking mechanism is in the first locked position, the indexing pin is configured to interlock with a notch of the set of notches in an interlocked position thereby preventing the shoulder brace and the base portion from sliding relative to each other.

Alternatively, the first locking mechanism may comprise at least one spine indexing pin coupled to the base portion, and a set of notches coupled to the shoulder brace. When the first locking mechanism is in the first locked position, the indexing pin is configured to interlock with a notch of the set of notches in an interlocked position thereby preventing the shoulder brace and the base portion from sliding relative to each other.

The first locking mechanism may further comprise a spring mechanism configured to urge the spine indexing pin into the interlocked position when the first locking mechanism is in the first locked position. When the first locking mechanism is in the first unlocked position, the spine indexing pin is moved out of the interlocked position.

The second locking mechanism may comprise a spine clamp piece coupled to a spine cam lever. The spine cam lever and the spine clamp piece may be configured to create a friction force between the base portion and the shoulder brace thereby preventing the shoulder brace and the base portion from sliding relative to each other when the second locking mechanism is in the second locked position.

In another aspect, an exoskeleton hip and trunk assembly is provided, which comprises a centerpiece and a first hip frame extending from a first side of the centerpiece. The exoskeleton assembly further comprises a first locking mechanism configured to alternate between a first locked position and a first unlocked position, and a second locking mechanism, configured to alternate between a second locked position and a second unlocked position. When the first locking mechanism is in the first unlocked position and the second locking mechanism is in the second unlocked position, the first hip frame is free to slide relative to the centerpiece thereby adjusting the width of the hip assembly. When either the first locking mechanism is in the first locked position or the second locking mechanism is in the second locked position, the first hip frame and the centerpiece 102 are not free to slide relative to each other. The centerpiece may be configured to be positioned substantially behind the pelvis of a wearer.

The first locking mechanism may comprise a hip indexing pin coupled to the centerpiece and a set of notches coupled to the first hip frame. When the first locking mechanism is in the first locked position, the hip indexing pin is configured to interlock with a notch of the set of notches in an interlocked position thereby preventing the first hip frame and the centerpiece from sliding relative to each other. The locking mechanism may further comprise a spring mechanism configured to urge the hip indexing pin into the interlocked position when the first locking mechanism is in the locked position. When the first locking mechanism is moved to the first unlocked position, the hip indexing pin is moved out of the interlocked position.

The second locking mechanism may comprise a hip clamp piece coupled to a hip cam lever. The hip cam lever and the hip clamp piece may be configured to create a friction force between the first hip frame and the centerpiece thereby preventing the first hip frame and the centerpiece from sliding relative to each other when the second locking mechanism is in the second locked position.

The exoskeleton assembly may further comprise a leg assembly extending from the first hip frame. The leg assembly comprises an adjustable thigh assembly and an adjustable shank assembly. The adjustable thigh assembly is configured to be coupled to a thigh of a wearer and to move in unison with the thigh, and the adjustable shank assembly is configured to be coupled to a shank of a wearer and to move in unison with the shank.

The adjustable thigh assembly may comprise an upper thigh member slidably coupled to a lower thigh member, a third locking mechanism configured to alternate between a third locked position and a third unlocked position, and a fourth locking mechanism configured to alternate between a fourth locked position and a fourth unlocked position. When the third locking mechanism is in the third unlocked position and the fourth locking mechanism is in the fourth unlocked position, the upper thigh member and the lower thigh member are free to slide relative to each other thereby adjusting the length of the adjustable thigh assembly. When either the third locking mechanism is in the third locked position or the fourth locking mechanism is in the fourth locked position, the upper thigh member and the lower thigh member are not free to slide relative to each other.

The adjustable shank assembly may comprise an upper shank member slidably coupled to a lower shank member, a fifth locking mechanism configured to alternate between a fifth locked position and a fifth unlocked position, and a sixth locking mechanism configured to alternate between a sixth locked position and a sixth unlocked position. When the fifth locking mechanism is in the fifth unlocked position and the sixth locking mechanism is in the sixth unlocked position, the upper shank member and the lower shank member are free to slide relative to each other thereby adjusting the length of the adjustable shank assembly. When either the fifth locking mechanism is in the fifth locked position or the sixth locking mechanism is in the sixth locked position, the upper shank member and the lower shank member are not free to slide relative to each other.

In another aspect, an exoskeleton assembly is configured to be coupled to a wearer, said exoskeleton having a plurality of members moving in unison with corresponding body segments of the wearer. A first member is adjustable in length and comprises: a first component substantially parallel to a body segment, a second component substantially parallel to the body segment, a first locking mechanism configured to alternate between a first locked position and a first unlocked position, and a second locking mechanism configured to alternate between a second locked position and second unlocked position. When the first locking mechanism is in the first unlocked position and the second locking mechanism is in the second unlocked position, the first component and the second component are free to slide relative to each other thereby adjusting the length of the first member. When either the first locking mechanism is in the first locked position or the second locking mechanism is in the second locked position, the first component and the second component are not free to slide relative to each other.

The first locking mechanism may comprise at least one indexing pin coupled to the first component, and a set of notches coupled to the second component. When the first locking mechanism is in the first locked position, the indexing pin is configured to interlock with a notch of the set of notches in an interlocked position. The first locking mechanism may further comprise a spring mechanism configured to urge the indexing pin into the interlocked position when the first locking mechanism is in the first locked position. When the first locking mechanism is in the first unlocked position, the indexing pin is moved out of the interlocked position.

The second locking mechanism may comprise a clamp piece coupled to a cam lever. The cam lever and the clamp piece may be configured to create a friction force between the first component and the second component thereby preventing the first component and the second component from sliding relative to each other when the second locking mechanism is in the second locked position.

Also described herein is a system comprising a controller, a power source, and a torso assembly comprising. The torso assembly comprises a centerpiece, an adjustable spine assembly extending vertically from the centerpiece. The spine structure comprises a base portion including a first set of notches, and a shoulder brace slidably coupled to the base portion. The torso assembly further comprises a first adjustment mechanism configured to allow the shoulder brace to slide along the base portion when in a first mode, and interlock with a notch of the first set of notches to secure the shoulder brace upon the base portion when in a second mode. The torso assembly further comprises a first hip frame coupled to the centerpiece at a first end of the first hip frame and extending laterally from a first side of the centerpiece, and a second hip frame coupled to the centerpiece at a first end of the second hip frame and extending laterally from a second side of the centerpiece.

The first adjustment mechanism may comprise an indexing pin configured to interlock with the first set of notches, and a clamping piece coupled to a cam lever. The cam lever and the clamping piece may be configured to create friction against the base portion of the spine structure.

The system may further comprise a second adjustment mechanism configured to allow the first hip frame to slide laterally relative to the centerpiece when in a third mode, and interlock with a notch of a second set of notches located on the first hip frame to secure the first hip frame upon the centerpiece when in a fourth mode.

The system may further comprise a third adjustment mechanism configured to allow the second hip frame to slide laterally relative to the centerpiece when in a fifth mode, and interlock with a notch of a third set of notches located on the second hip frame to secure the second hip frame upon the centerpiece when in a sixth mode.

The system may further comprise a first motor mount located at a second end of the first hip frame, a first motor assembly coupled to the first motor mount, a second motor mount located at a second end of the second hip frame, and a second motor assembly coupled to the second motor mount.

The system may further comprise one or more lights capable of emitting one or more colors of light. Each of the one or more colors of light corresponds to an operational state of the exoskeleton assembly. The operational state includes one of the following: a standing state, a walking state, and a seated state.

Further provided is a method of adjusting an exoskeleton assembly, as described herein. The method comprises alternating between a first mode and a second mode of a first clamp mechanism. In the first mode a user may slide the shoulder brace along the base portion. In the second mode, the user may interlock the clamp mechanism with a notch of the first set of notches to secure the shoulder brace upon the base portion.

These and other embodiments are described further below with reference to the figures.

BRIEF DESCRIPTION OF THE DRAWINGS

The disclosure may best be understood by reference to the following description taken in conjunction with the accompanying drawings, which illustrate particular embodiments of the present disclosure.

DESCRIPTION OF PARTICULAR EMBODIMENTS

Figure 1:
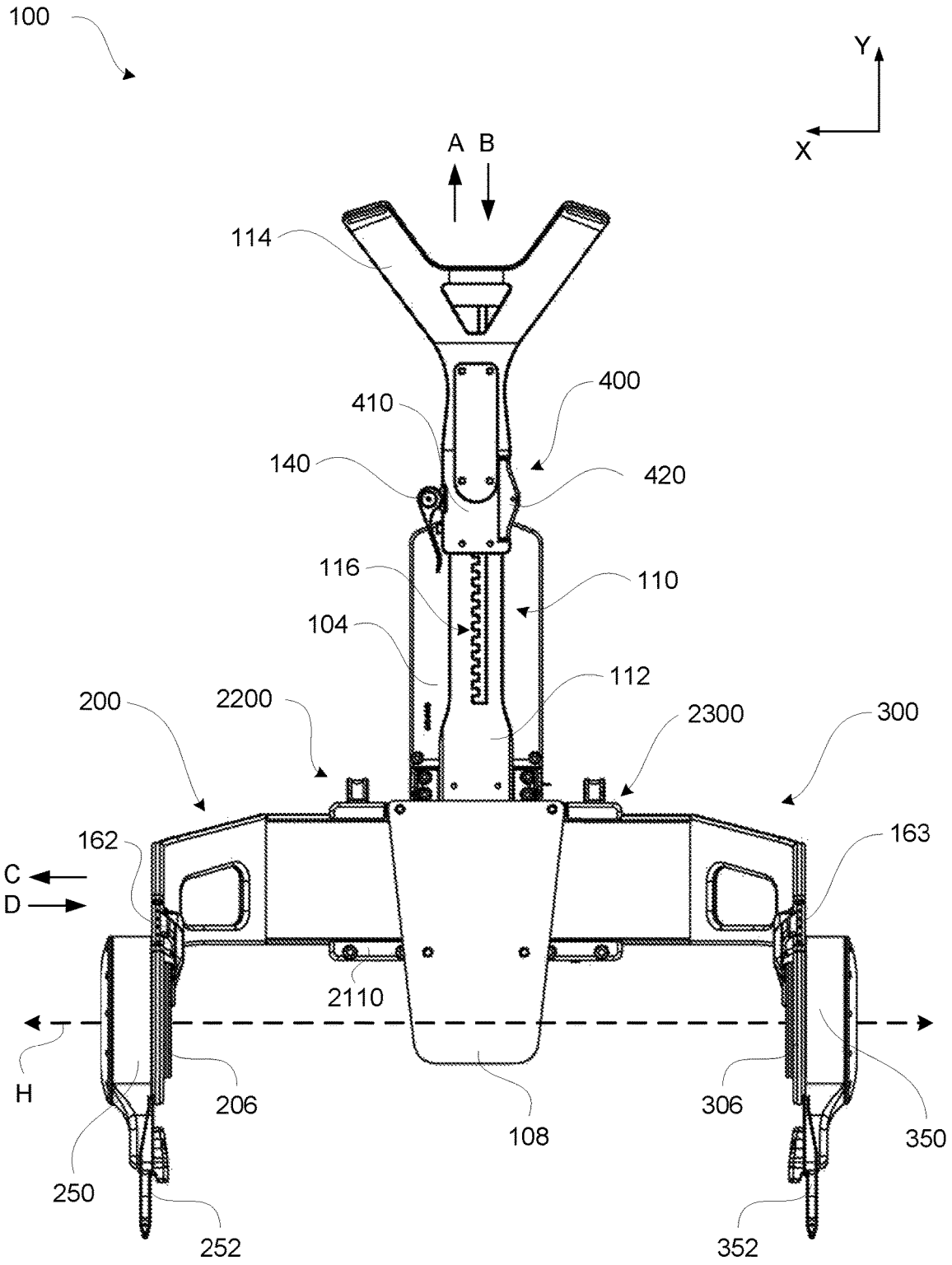
FIG. 1 illustrates a front view of a trunk and hip assembly for exoskeleton apparatus.

Reference will now be made in detail to some specific examples of the disclosure including the best modes contemplated by the inventor for carrying out the disclosure. Examples of these specific embodiments are illustrated in the accompanying drawings. While the disclosure is described in conjunction with these specific embodiments, it will be understood that it is not intended to limit the disclosure to the described embodiments. On the contrary, it is intended to cover alternatives, modifications, and equivalents as may be included within the spirit and scope of the disclosure as defined by the appended claims.

For example, the structure and mechanisms of the present disclosure will be described in the context of particular materials. However, it should be noted that the structure and mechanisms of the present disclosure may consists of a variety of different materials. In the following description, numerous specific details are set forth in order to provide a thorough understanding of the present disclosure. Particular example embodiments of the present disclosure may be implemented without some or all of these specific details. In other instances, well known structures, mechanisms, and materials have not been described in detail in order not to unnecessarily obscure the present disclosure.

As used herein, movement, motion, direction, or access refer to movement along a horizontal axis and a vertical axis, wherein the horizontal axis is parallel to the ground and vertical axis is perpendicular to the ground. As used herein, movement, motion, direction, or access in a "substantially horizontal" or "substantially lateral" direction refers to movement, motion, direction, or access where the horizontal component is greater or equal to the vertical component. As used herein, movement, motion, direction, or access in a "substantially vertical" direction refers to movement, motion, direction, or access where the vertical component is greater or equal to the horizontal component. In cases where both components are the same, either term could refer to the movement.

Overview

The general purpose of the present disclosure, which will be described subsequently in greater detail, is to provide an adjustable assembly framework for an exoskeleton apparatus. The assembly framework may comprise of an adjustable hip assembly, an adjustable spine assembly, an adjustable thigh assembly, and an adjustable shank assembly. A hip and trunk assembly comprises the adjustable hip assembly and the adjustable spine assembly. Leg assemblies coupled to the hip and trunk assembly comprise the adjustable thigh assembly and adjustable shank assembly.

Such adjustable assembly may provide a mechanism for toolless adjustability of various components to fit individuals of various sizes and measurements, as well as provide additional comfort to the user of the device when worn. In other words, the described systems provide a convenient way to quickly and conveniently fit an exoskeleton to particular users without the need for additional tools or devices.

Furthermore, the adjustable assembly provides means for indicating operational states and/or statuses of the exoskeleton. These and other novel features that result in a novel assembly for exoskeletons that are not anticipated, rendered obvious, suggested, or even implied by any of the prior exoskeleton assemblies, either alone or in any combination thereof. Other objects and advantages of the present apparatus, systems, and methods will be explained and it is intended that these objects and advantages are within the scope of the present invention.

To attain this, the embodiments presently described generally comprise of:

- Integrated locking mechanism. Such locking mechanism may be released to allow different components of the assembly to slide and adjust to a customized fit for an individual user.
- Notification lighting. Such lighting may be used to indicate the operational state of an assembly and/or exoskeleton apparatus, increasing the ease of use by an individual and/or a physical therapy professional.

The described hip and torso assembly is configured to be coupled to a user (or "wearer"), and comprises a centerpiece with a vertical adjustable spine assembly configured to be positioned substantially behind the wearer and parallel to the wearer's spine. The hip and trunk assembly may further comprise hip frames extending horizontally from the centerpiece surrounding the user's hips.

The adjustable spine assembly comprises a base portion and a shoulder brace slidably coupled to the base portion via a spine adjustment mechanism. As used herein, the term "adjustable spine assembly" may be used interchangeably with the term "adjustable spine," "spine structure," or "spine assembly." The spine adjustment mechanism comprises at least one locking mechanism, which may be configured for extending and contracting the length of the adjustable spine to fit particular users. The spine adjustment mechanism's locking mechanism may comprise an indexing mechanism which includes spine indexing notches with alternating grooves and processes on the base portion. A spine indexing pin located on the shoulder brace is configured to reversibly interlock with the grooves. In an unlocked position, the shoulder brace may be moved relative to the base portion to a desired position. In the locked position the shoulder brace is not moveable relative to the base portion.

The hip assembly comprises of at least one hip frame extending from a side of a centerpiece hip frame. As used herein, the term "centerpiece hip frame" may be referred to simply as "centerpiece." The hip frame may be referred to herein as "side hip frame" and may be a left side hip frame extending from the left side of the centerpiece, or a right side hip frame extending form the right side of the centerpiece. The width between a side hip frame and the user's spine, or the width between a right and left side hip frame may also be adjusted via hip adjustment mechanisms. Each hip adjustment mechanism comprises at least one locking mechanism, which allows the corresponding side hip frame to be adjusted laterally relative to the centerpiece hip frame. Each locking mechanism may comprise a hip indexing mechanism which includes notches with alternating grooves and processes on a hip frame. A hip indexing pin located on the centerpiece is configured to reversibly interlock with the grooves on the hip frame. In an unlocked position, the hip frame may be moved relative to the centerpiece to a desired position. In the locked position, the hip frame is not moveable relative to the centerpiece.

The spine adjustment mechanism and the hip adjustment mechanisms may each comprise a second locking mechanism. The respective locking mechanisms may comprise clamping mechanism for securing and stabilizing the position of the shoulder brace and the hip frames, respectively. The spine clamp mechanism may comprise a spine cam lever coupled to a spine clamp piece located on the shoulder brace. In the closed position, the spine cam lever causes the spine clamp piece to apply compressional friction against the base portion, which secures the shoulder brace in a position even if indexing pin is in the unlocked position. In the open position, the spine cam lever releases the force on the clamp piece, and the base portion.

Each hip clamp mechanism may comprise a hip cam lever which causes a compression force to be applied to the hip frames via a hip clamp piece in a closed position. Thus, when the hip cam lever is in the closed position, the positions of hip frames are secured, even if the corresponding indexing pins are in the unlocked position. When the hip cam lever is in the open position, the compression force against the hip frames is released.

Such adjustments may be made without additional tools or devices. Thus, users of the exoskeleton assembly, including physical therapy professionals, may quickly and conveniently adjust the exoskeleton to fit the dimensions of a particular user. In an example embodiment, the minimum and maximum width between the hip frames and the minimum and maximum length of the spine portion are chosen to accommodate bodies within the 5th percentile American female to 95th percentile of American male.

In general, an exoskeleton assembly, described herein, is configured to be coupled to a wearer, and comprises of a plurality of members moving in unison with corresponding body segments of the wearer. At least one of the exoskeleton members is adjustable in length and comprises at least a first component and a second component which are substantially parallel to a body segment of the wearer. The exoskeleton members may further comprise at least a first locking mechanism and a second locking mechanism. Each locking mechanism is configured to alternate between at least two operational positions: a locked position and an unlocked position, such that when the first locking mechanism and the second locking mechanism are both in the respective unlocked positions, the first component and the second component are free to slide relative to each other thereby adjusting the length of the exoskeleton member. In some embodiments, the locking mechanism may be configured to operate in other positions in addition to the locked position and the unlocked position.

When either the first locking mechanism or the second locking mechanism is in the respective locked position, the first component and the second component are not free to slide relative to each other. The use of two locking mechanisms (the first and the second locking mechanism) increases system safety, by adding redundancy. If either locking mechanism fails, the other locking mechanism acts as a fail-safe to allow continued use of the exoskeleton safely.

In some embodiments, the first locking mechanism comprises at least one indexing pin coupled to the first component and a set of notches coupled to the second component. When the first locking mechanism is moved to its locked position the indexing pin is configured to interlock with a notch of the set of notches in an interlocked position. In some embodiments, the first locking mechanism includes a spring mechanism, which is configured to urge the indexing pin into the interlocked position when the first locking mechanism is in its locked position. When the indexing pin is moved out of the interlocked position, the first locking mechanism is moved to its unlocking position.

In some embodiments, the second locking mechanism comprises a clamp piece coupled to a cam lever wherein the cam lever and the clamp piece are configured to create a friction force between the first component and the second component preventing the first component and the second component from sliding relative to each other when the second locking mechanism is in its locked position.

It should be appreciated that the indexing pin may be coupled to the second component while the notches are coupled to the first component. In some embodiments, both first and second locking mechanism may utilize the same mechanical principles. For instance, both first and second locking mechanism may use indexing pins to interlock with notches, or both first and second locking mechanism my comprise clamping mechanisms to create friction force between two members.

Notification lights may also be positioned on the hip frames or any one of various other locations on the assembly that is easily viewable by a user, viewer, or physical therapy professional. Such lights may comprise one or more light emitting diodes (LEDs) of various colors. Each color may correspond to different modes and operational states of the exoskeleton assembly. This provides a system for easily determining the operational state of an exoskeleton assembly without the need for additional devices or tools.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction and to the arrangements of the components set forth in the following description or illustrated in the drawings. The disclosed systems and methods are capable of other embodiments and of being practiced and carried out in various ways. Also, it is to be understood that the phraseology and terminology employed herein are for the purpose of the description and should not be regarded as limiting.

To the accomplishment of the above and related objects, the disclosed apparatus, systems and methods may be embodied in the form illustrated in the accompanying drawings, attention being called to the fact, however, that the drawings are illustrative only, and that changes may be made in the specific construction illustrated.

Example Embodiments

Turning now descriptively to the drawings, in which similar reference characters denote similar elements throughout the several views, the attached figures illustrate an adjustable trunk and hip assembly for an exoskeleton apparatus.

Figure 2:
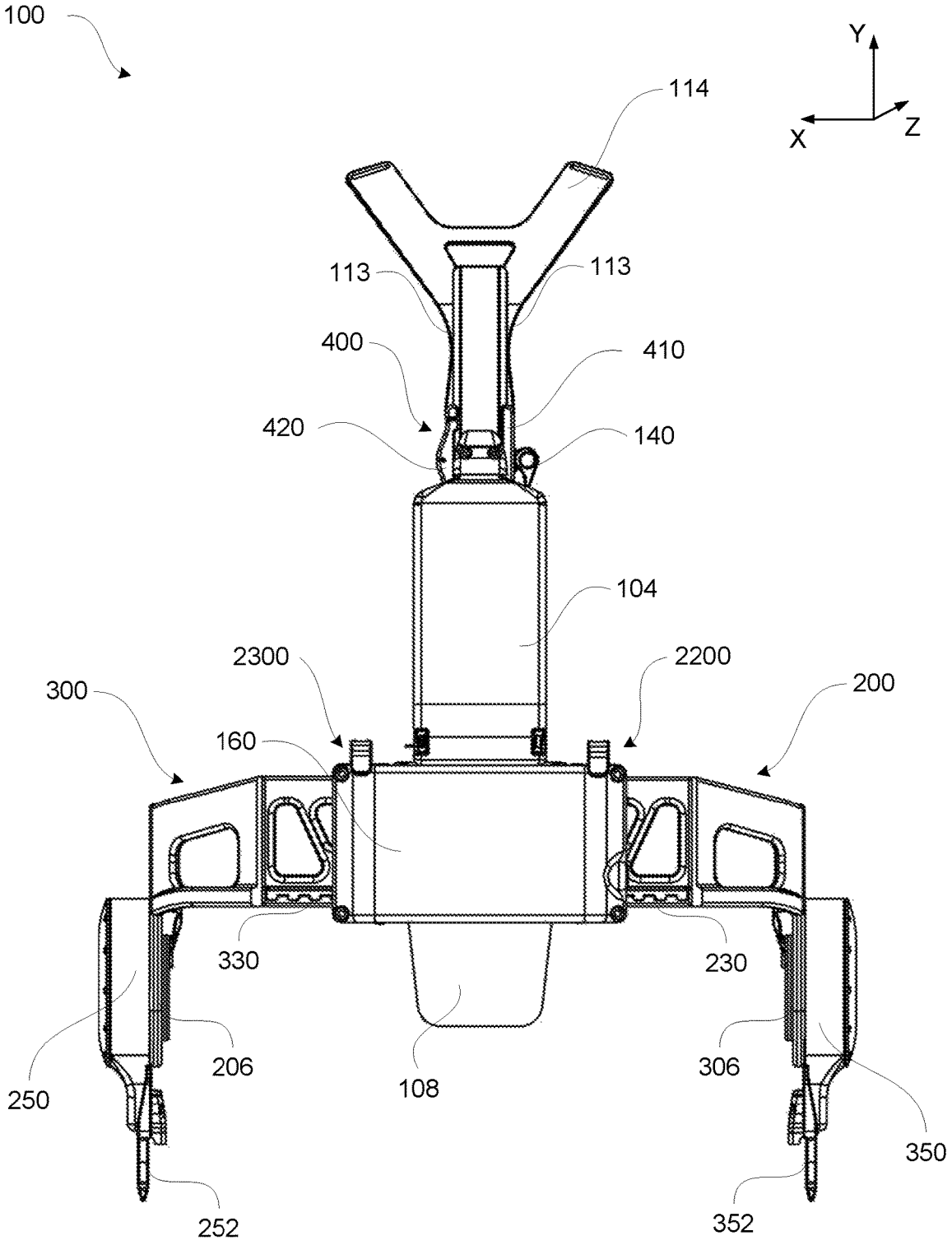
FIG. 2 is a rear view thereof.
Figure 3:
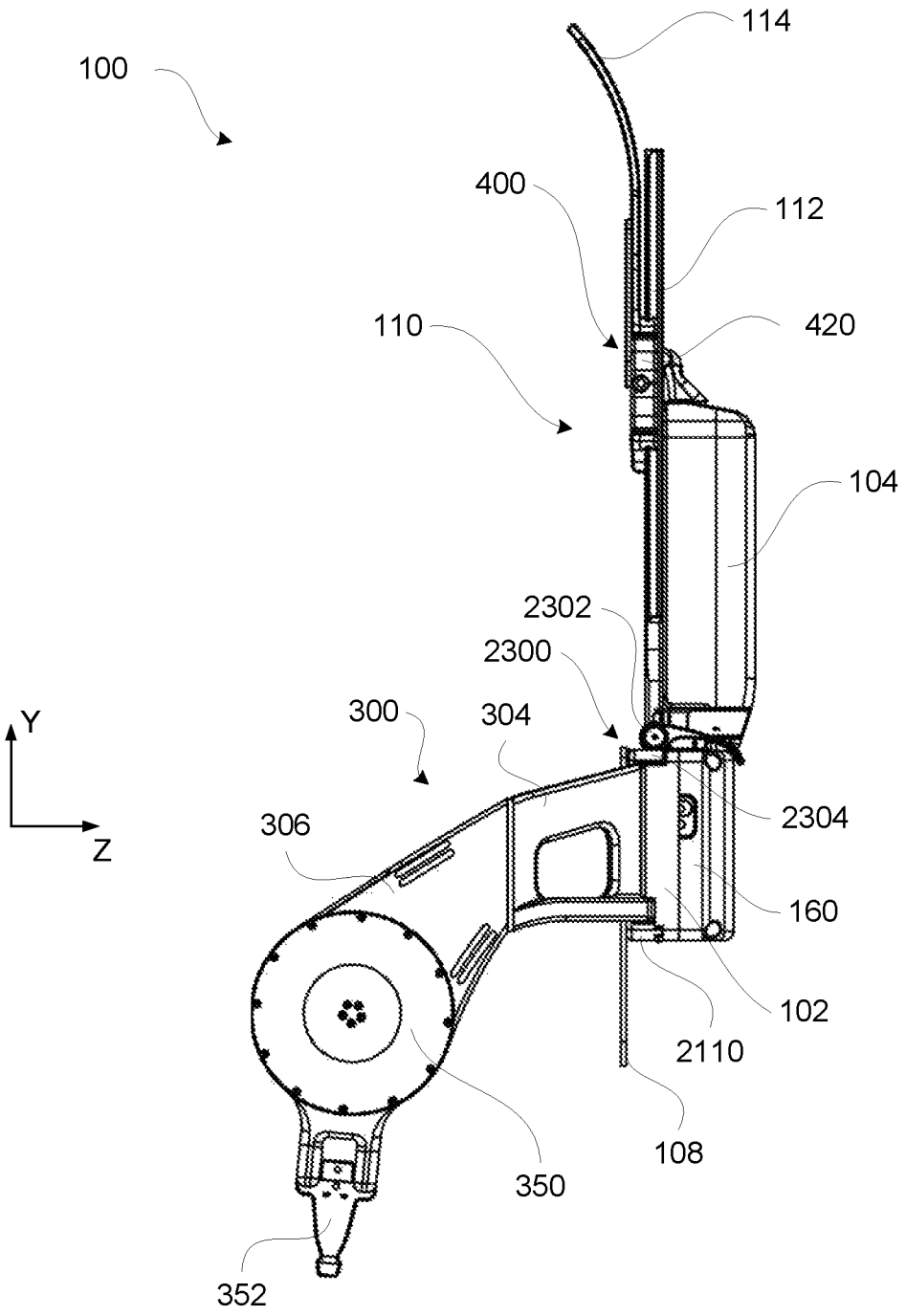
FIG. 3 is a left side view thereof.
Figure 4:
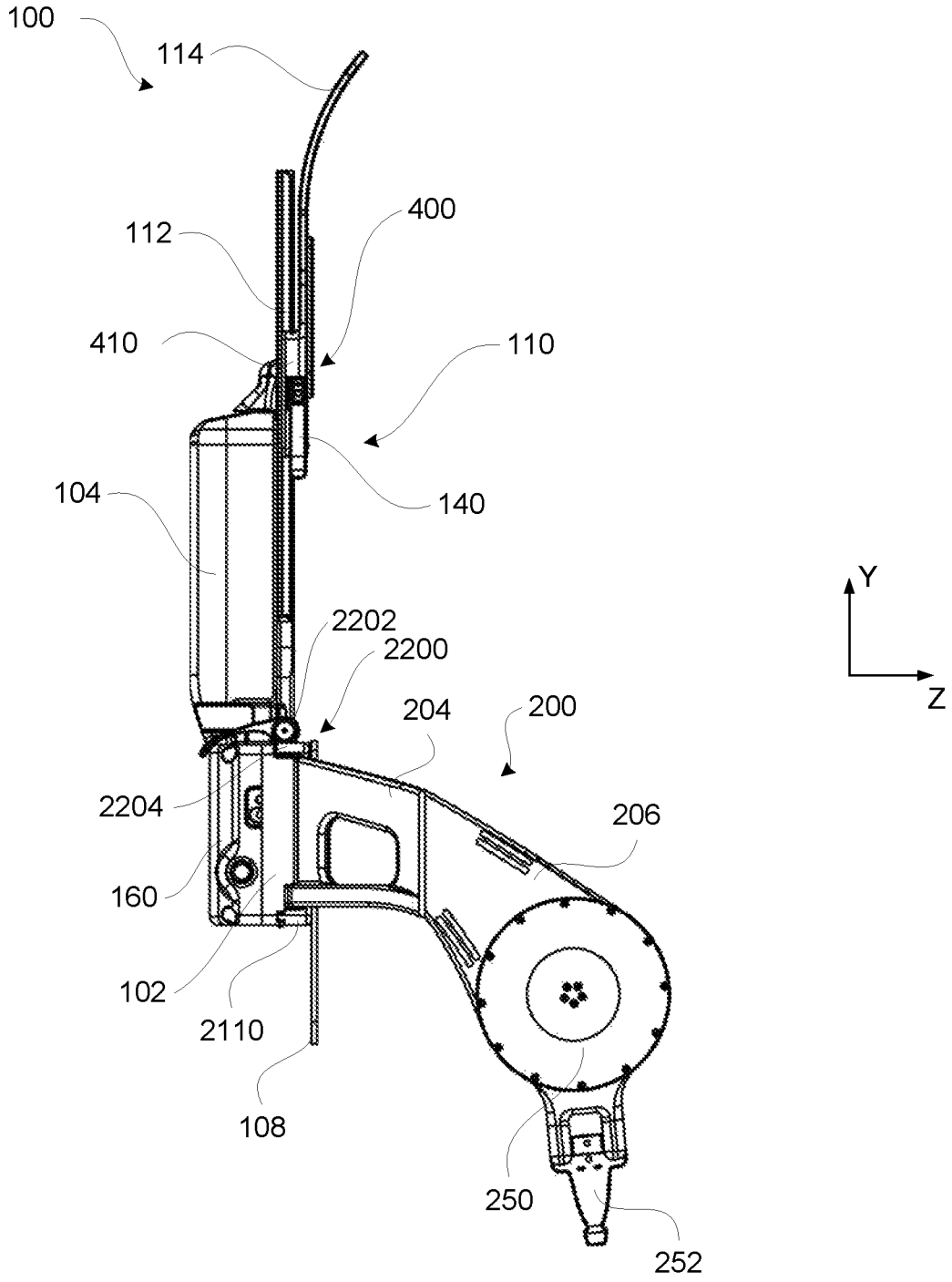
FIG. 4 is a right side view thereof.
Figure 5:
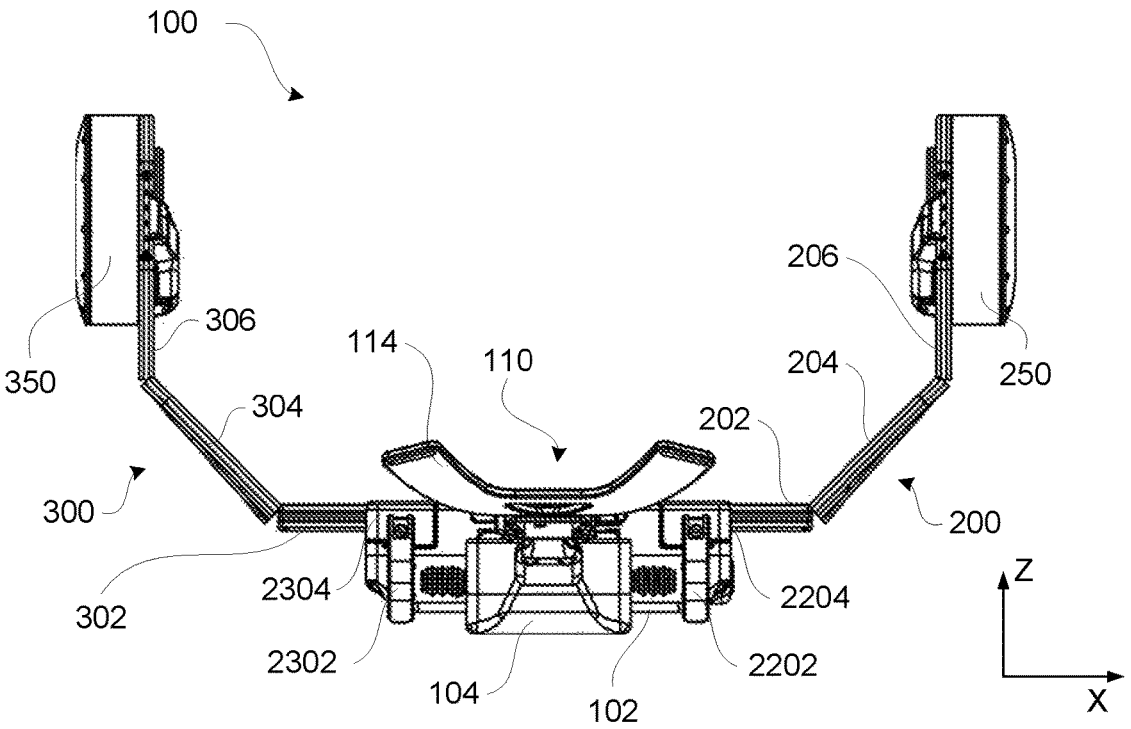
FIG. 5 is a top view thereof.
Figure 6:
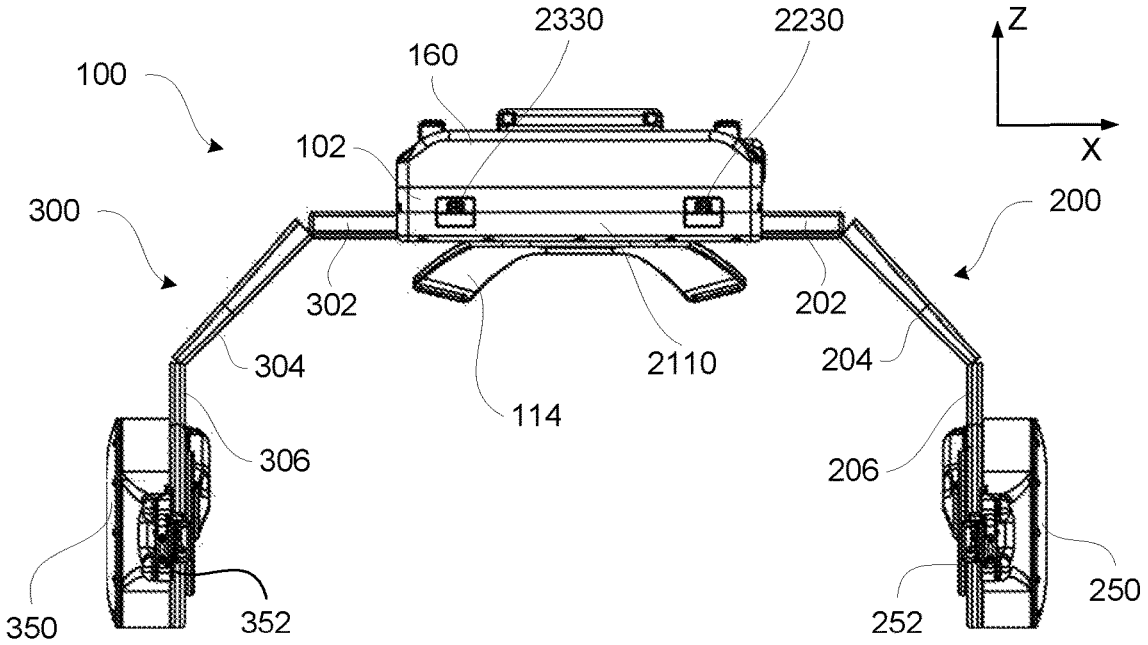
FIG. 6 is a bottom view thereof.

With reference to FIG. 1, shown is a front view of a trunk and hip assembly 100 for an exoskeleton apparatus. FIG. 2 illustrates a rear view of assembly 100 and corresponding components described above. FIG. 3 illustrates a left side view of trunk and hip assembly 100. FIG. 4 is a right side view thereof. FIG. 5 is a top view thereof. FIG. 6 is a bottom view thereof.

Figure 7:
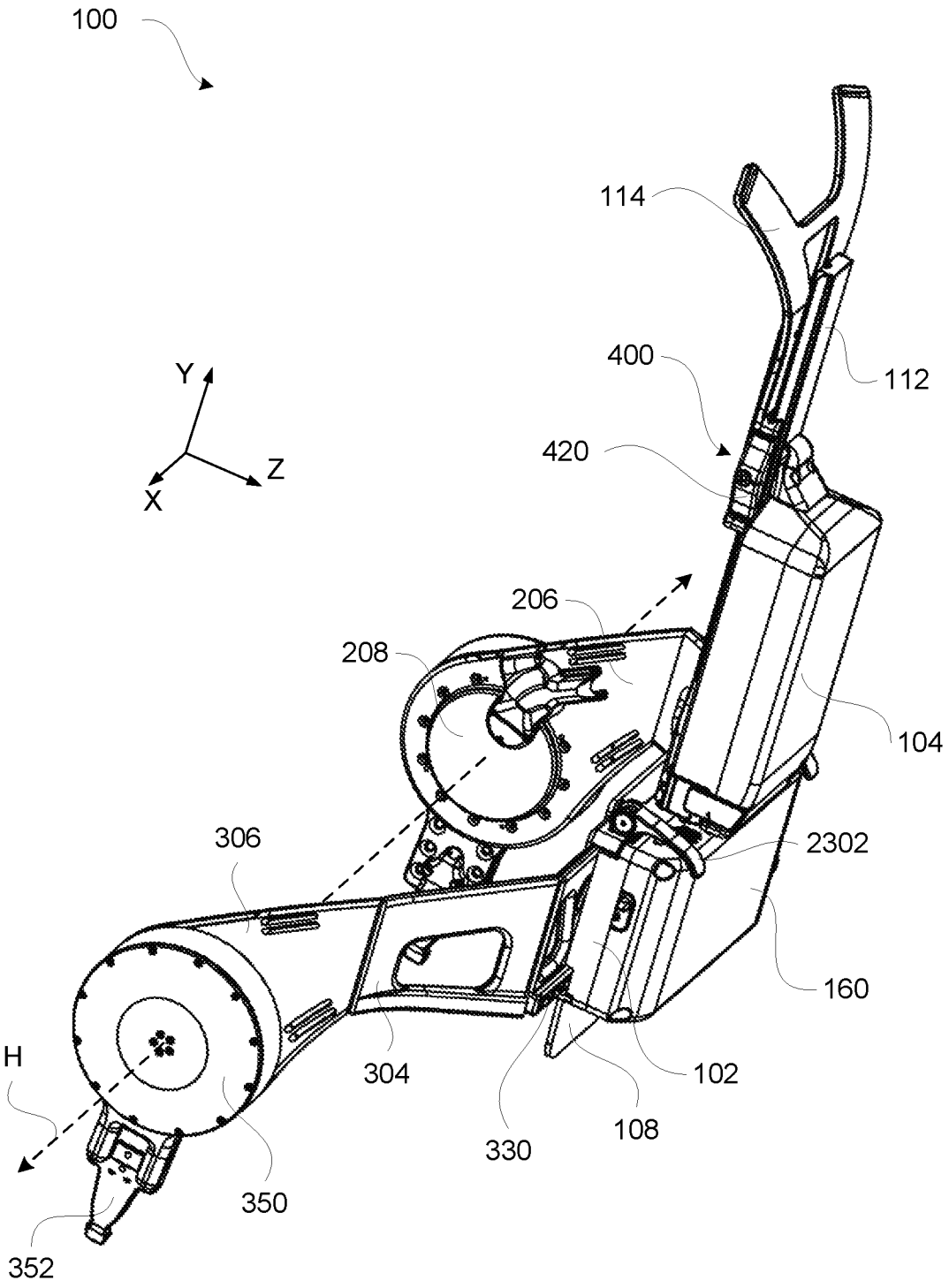
FIG. 7 is a perspective view thereof showing rear, top, and left sides.
Figure 8:
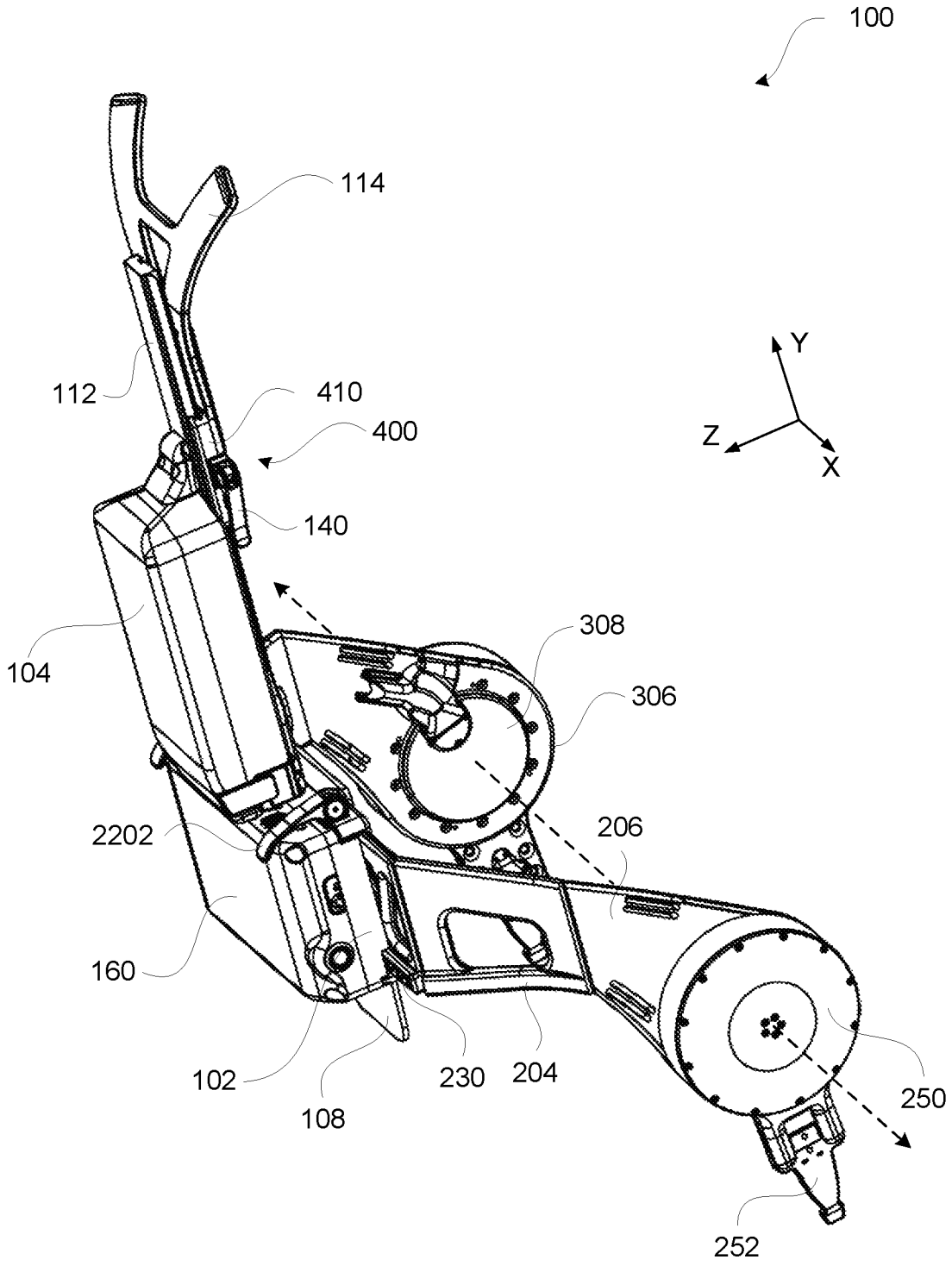
FIG. 8 is a perspective view thereof showing rear, top, and right sides.
Figure 9:
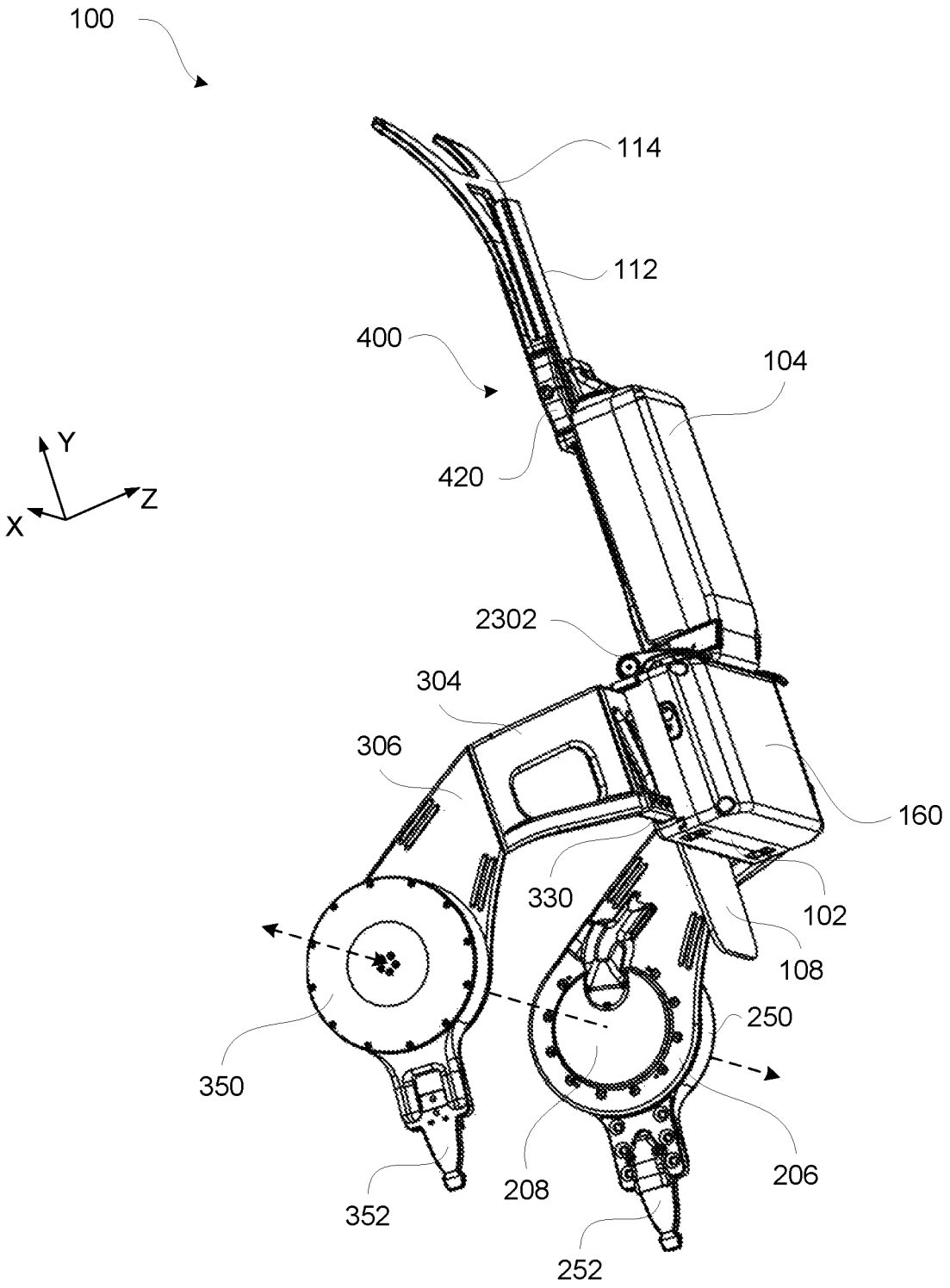
FIG. 9 is a perspective view thereof showing rear, bottom, and left sides.
Figure 10:
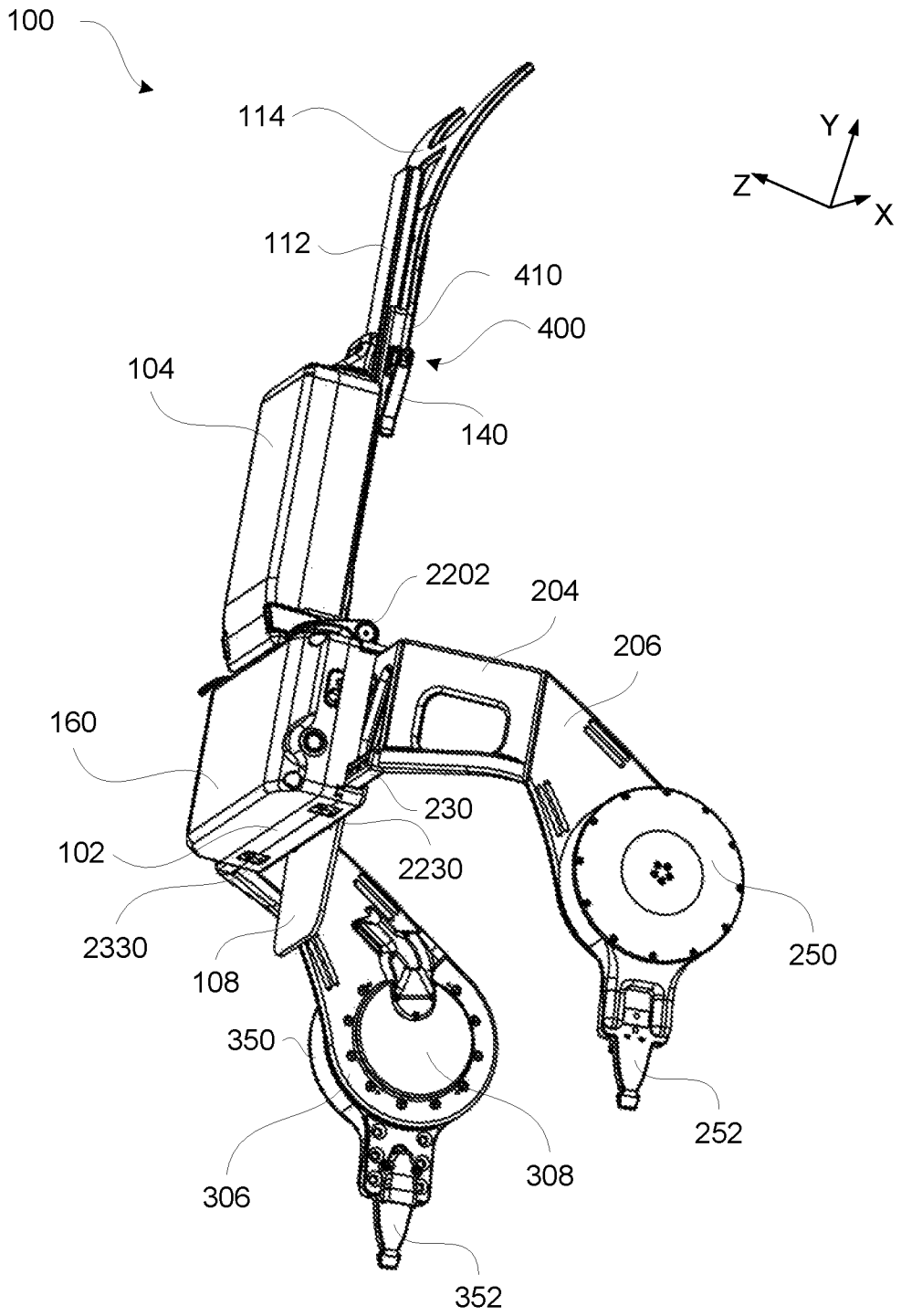
FIG. 10 is a perspective view thereof showing rear, bottom, and right sides.
Figure 11:
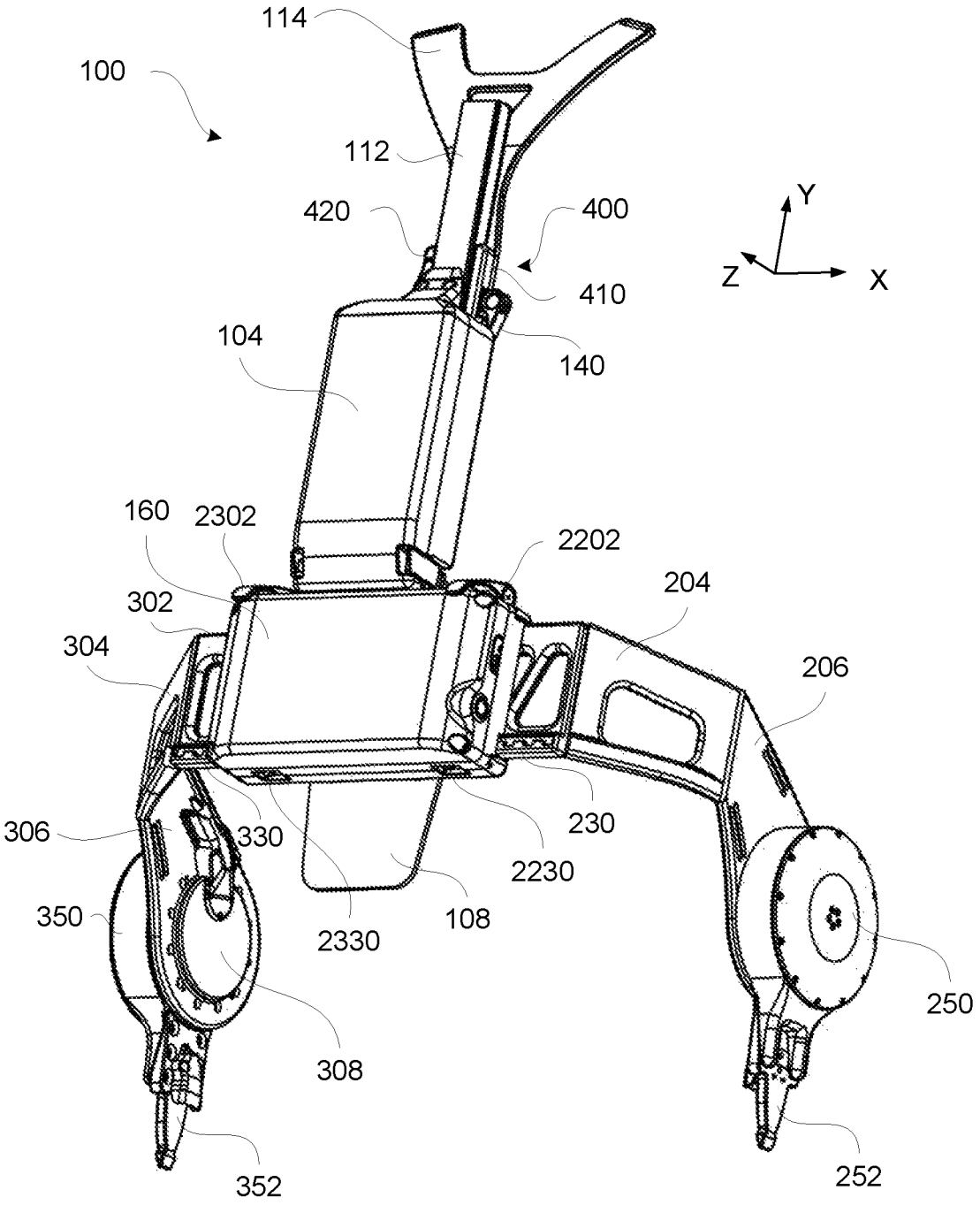
FIG. 11 is another perspective view thereof showing rear, bottom, and right sides.

FIGS. 7 to 11 illustrate various perspective views of hip and trunk assembly 100 and corresponding components. FIG. 7 is a perspective view thereof showing rear, top, and left sides. FIG. 8 is a perspective view thereof showing rear, top, and right sides. FIG. 9 is a perspective view thereof showing rear, bottom, and left sides. FIG. 10 is a perspective view thereof showing rear, bottom, and right sides. FIG. 11 is another perspective view thereof showing rear, bottom, and right sides. FIGS. 12 to 17 illustrate additional perspective views of hip and trunk assembly 100 and corresponding components.

The exoskeleton assembly 100 comprises centerpiece 102, battery pack 104, sacral plate 108, and adjustable spine assembly 110 including base portion 112 and shoulder brace 114. In various embodiments, sacral plate 108 is configured to rest upon a user's lower back. For example, when operated by a user, sacral support 108 may rest upon a user's back along the sacral and/or lumbar regions. As shown in the various Figures herein, sacral support 108 includes a flat surface. However, in some embodiments, the surface of sacral 108 may be curved to comprise an anthropomorphic profile corresponding to the curvature of a user's lower back region.

In various embodiments, adjustable spine assembly 110 is coupled to centerpiece 102 and extends substantially vertically from centerpiece 102. Adjustable spine assembly 110 may comprise a base portion 112 and shoulder brace 114. In some embodiments, base portion 112 extends upward from centerpiece 102 along the Y-axis to a distal end. Shoulder brace 114 may be coupled to base portion 112 via spine adjustment mechanism 400.

As illustrated, shoulder brace 114 may comprise a fork structure configured to surround the user's neck and hover near a user's shoulders. In various embodiments, shoulder brace 114 is configured to slide along base portion 112 in the directions indicated by arrows A and B. Shoulder brace 114 may comprise spine adjustment mechanism 400 which works in conjunction with notches 116 on base portion 112 to secure shoulder brace 114 at various positions in order to achieve a desired overall length of adjustable spine assembly 110.

Figure 14:
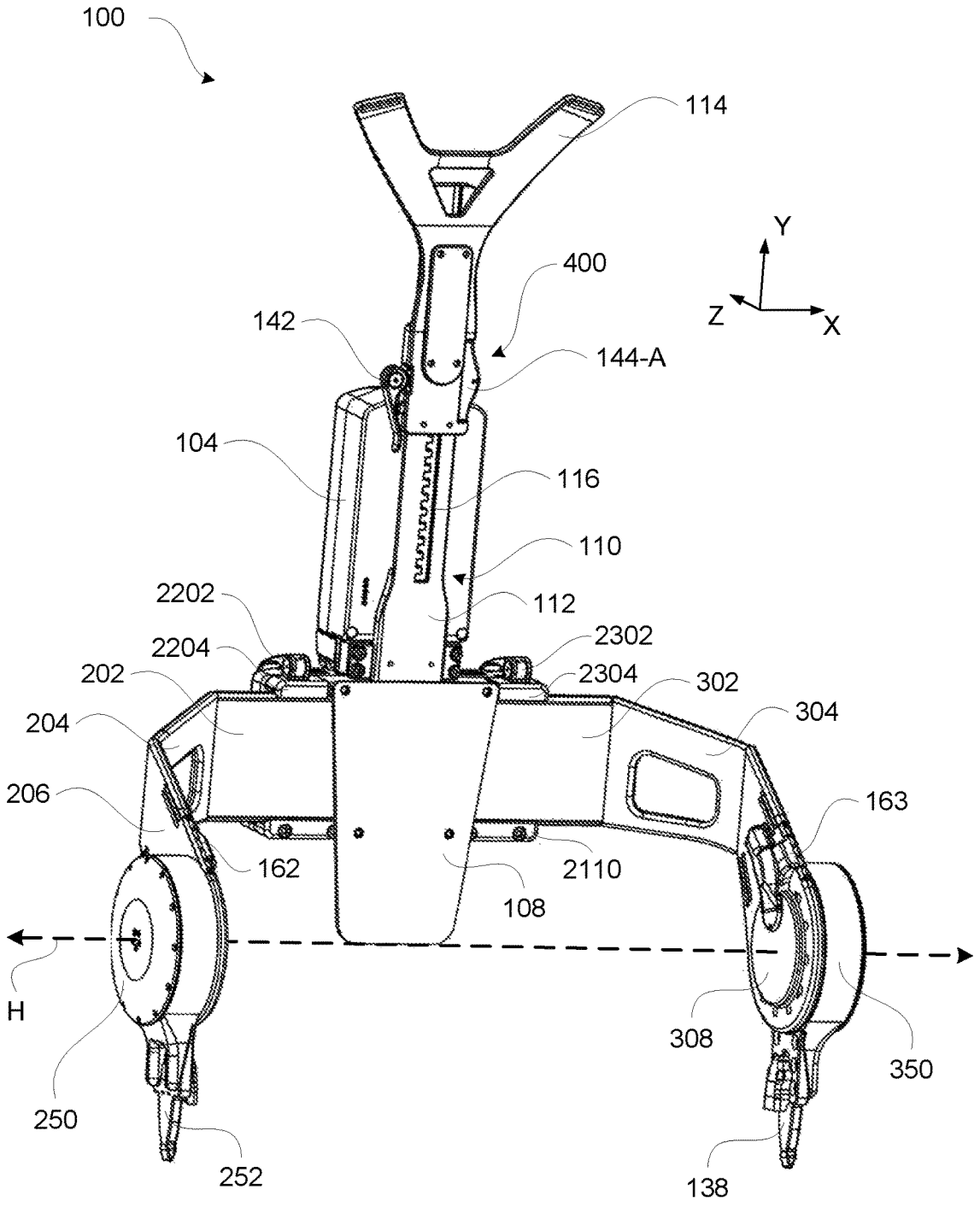
FIG. 14 illustrates a perspective view of a trunk and hip assembly for exoskeleton apparatus showing top, front, and right sides, in accordance with one or more embodiments.
Figure 15:
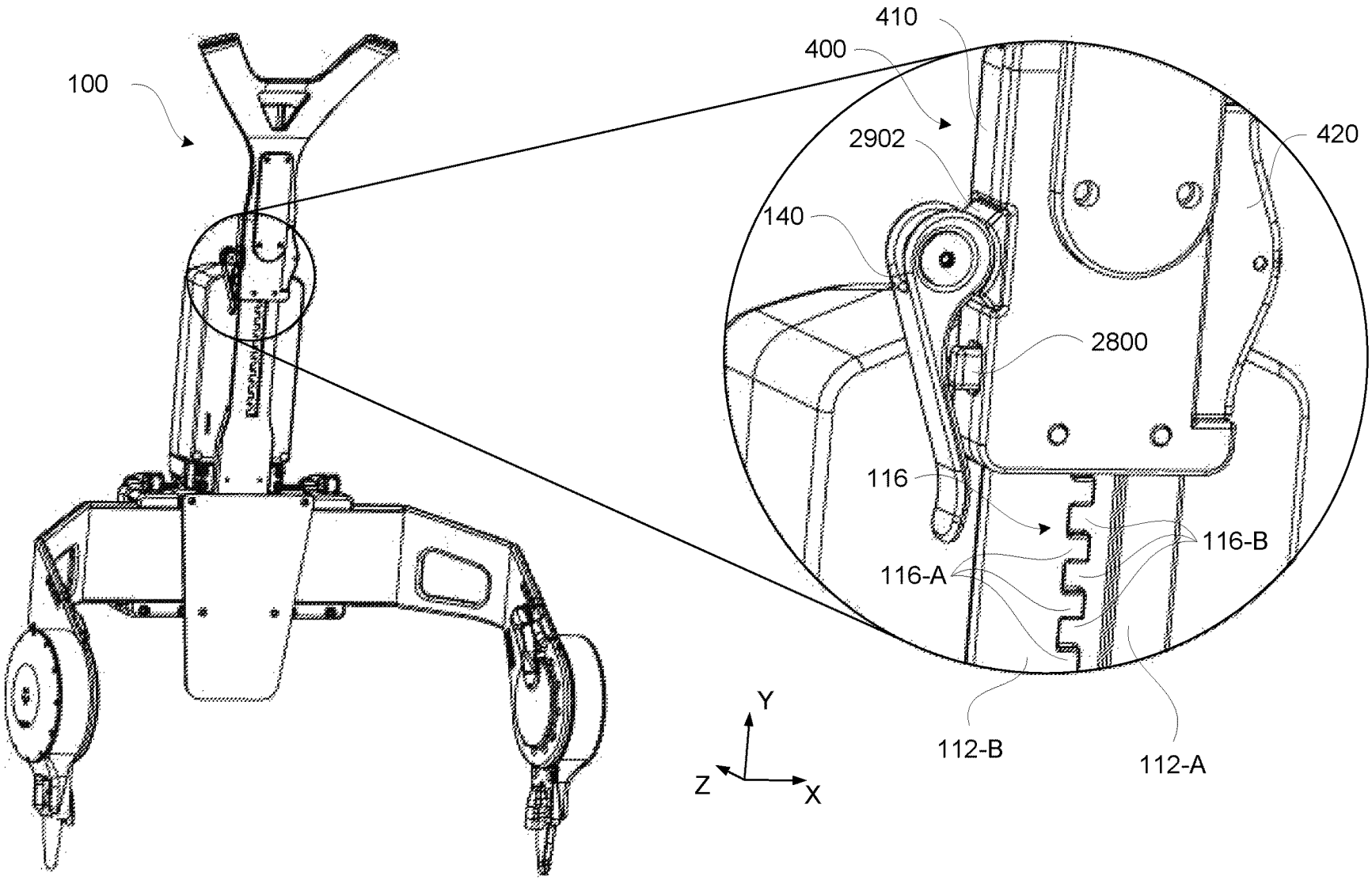
FIG. 15 illustrates an enlarged fragmentary perspective view of that shown in FIG. 14 showing a clamp mechanism located on a spine portion in greater detail, in accordance with one or more embodiments.

FIG. 14 illustrates a perspective view of a trunk and hip assembly for exoskeleton apparatus showing top, front, and right sides, in accordance with one or more embodiments. FIG. 15 illustrates an enlarged fragmentary perspective view of that shown in FIG. 14 showing spine adjustment mechanism 400 located on the spine portion 110 in greater detail, in accordance with one or more embodiments. Spine adjustment mechanism 400 may comprise spine cam lever 140, slider body 410, and clamping piece 420, and may further function to add stability and security to the movement of shoulder brace 114 about base portion 112. As shown in FIG. 15, notches 116 may comprise rectangular processes 116-A of surface structure 112-B with alternating rectangular grooves 116-B. Although rectangular processes and grooves are illustrated, it should be recognized that notches 116 may comprise any one of various appropriate shapes, such as triangular or circular grooves.

As further shown in FIG. 15, spine adjustment mechanism 400 may further comprise spine indexing pin 2800 which may be operated by a user to release the spine indexing pin from notches 116 to permit the sliding of shoulder brace 114. Additional components of spine adjustment mechanism 400 are further described with reference to FIGS. 26-32.

As further depicted in FIG. 1, assembly 100 further comprises at least one side hip frame, such as right hip frame 200 or left hip frame 300, which extend laterally from the right and left sides of centerpiece 102, respectively. Right hip frame comprises the following portions: right hip slider 202, right hip diagonal 204, and right motor mount 206. Similarly, left hip frame 300 comprises the following portions: left hip slider 302, left hip diagonal 304, and left motor mount 306. In some embodiments, the portions of each hip frame may be welded together or attached by other appropriate means. In some embodiments, each hip frame may be a single monolithic component. Each motor mount 206 and 306 may comprise a right mount plate 208 and left mount plate 308, respectively.

In various embodiments, hip frames 200 and/or 300 are configured to be positioned about a user's pelvis such that right motor mount plate 208 and left motor mount plate 308 are positioned at the substantially parallel to the user's respective hip joints. As such, an axis H positioned through the center of each motor mount plate may be substantially aligned with the axes of flexion and extension of the user's hip joints. Right motor assembly 250 and left motor assembly 350 may be mounted onto the hip frames at right motor mount plate 208 and left motor mount plate 308, respectively. In some embodiments, right motor assembly 250 may be an integral component of right motor mount 206. Similarly, left motor assembly 350 may be an integral component of left motor mount 306.

Motor assemblies 250 and 350 may be secured to motor mount plates 208 and 308, respectively. Motor assemblies 250 and 350 may be one of various types of motors, including DC motors, servo motors, stepper motors, etc. In one aspect, motors 250 and 350 comprise brushless DC electric motors, also known as electronically commutated motors or synchronous DC motors. Such motors may comprise an inverter or switching power supply which produces an AC electric current to drive each phase of the motor via a closed loop controller. The controller may provide pulses of current to the motor windings that control the speed and torque of the motor.

Motors 250 and 350 may provide rotational movement about axis H, which is further illustrated in FIGS. 7 and 14. In various embodiments, assembly 100 may be adjusted such that axis H is substantially aligned with the axis of extension and flexion of the user's hip joints. In some embodiments, movement of each motor is manually triggered by a user through an interface to the controller. In yet other embodiments, movement of each motor is automatically controlled by a processor of the controller.

In various embodiments, electronics enclosure 160 encloses various electronic components, including processors, wiring, and other controls, including a main controller or motherboard. In some embodiments, electronics enclosure 160 may comprise a programmable system controller, as well as one or more processors, memory, and one or more programs stored in the memory. Such systems and components may be powered by battery pack 104 to control and operate the motor assemblies, user interfaces, and other functionalities of assembly 100 as described herein. These and other systems and structural components of an exoskeleton assembly are described in U.S. patent application Ser. No. 13/818,338 by Kazerooni et al., filed on Aug. 23, 2011, titled ORTHESIS SYSTEM AND METHODS FOR CONTROL OF EXOSKELETONS, which is incorporated by reference herein in its entirety and for all purposes.

A hip adjustment mechanism provided comprises at least a first hip locking mechanism at each side hip frame which adjusts side hip frames 200 and/or 300 to desired positions to accommodate the anatomy of a user. In some embodiments, hip sliders 202 and 302 may be configured to slide laterally relative to centerpiece 102, in the directions indicated by arrows C and D, to adjust the width between hip frames 200 and 300. Centerpiece 102 may be configured with one or more sets of rails, including lower rail 2110, that guide the sliding movement of each hip frame, further described with reference to FIGS. 21 and 22. In some embodiments, each hip frame may be adjusted independently from the other hip frame.

Figure 12:
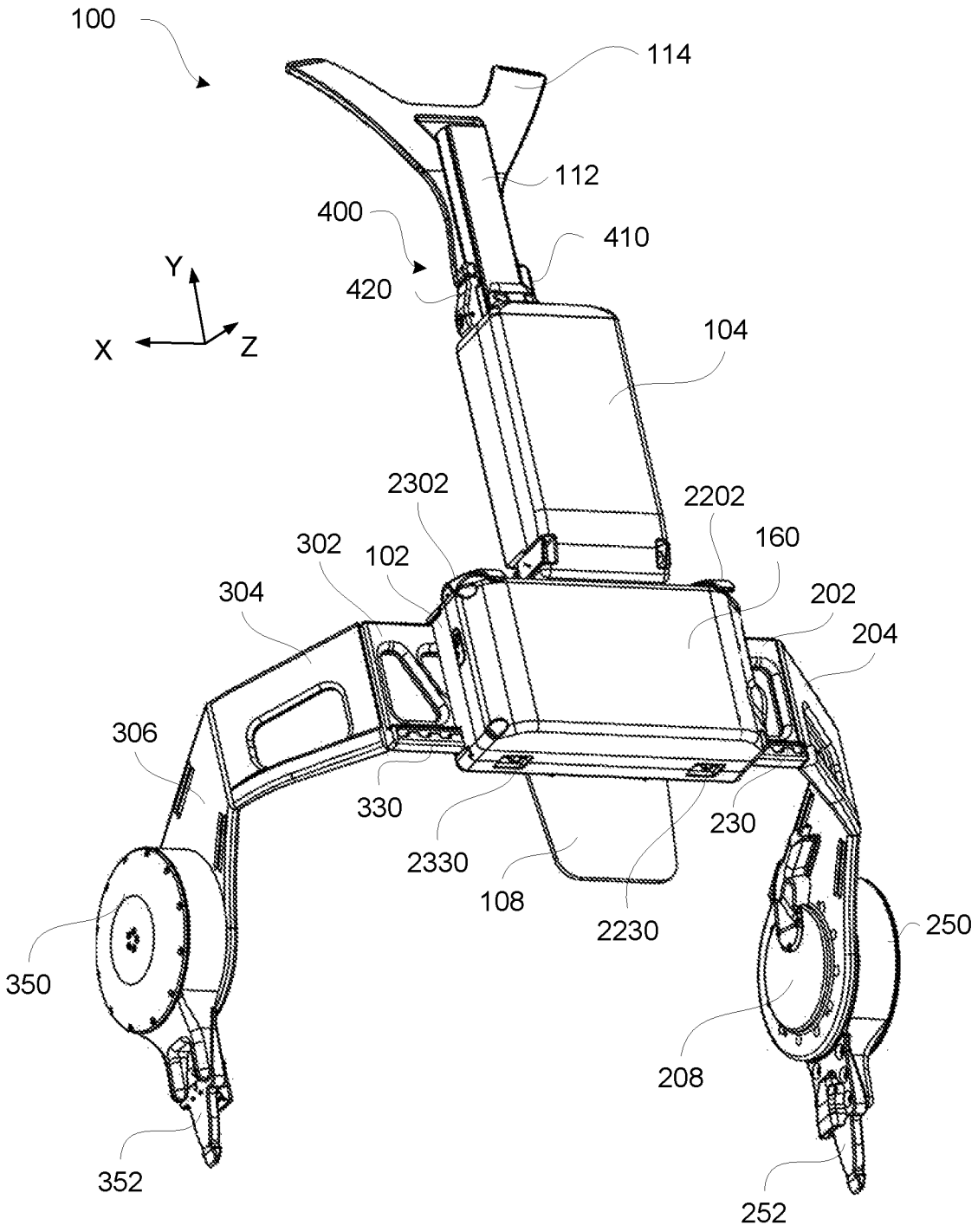
FIG. 12 is another perspective view thereof showing rear, bottom, and left sides.
Figure 13:
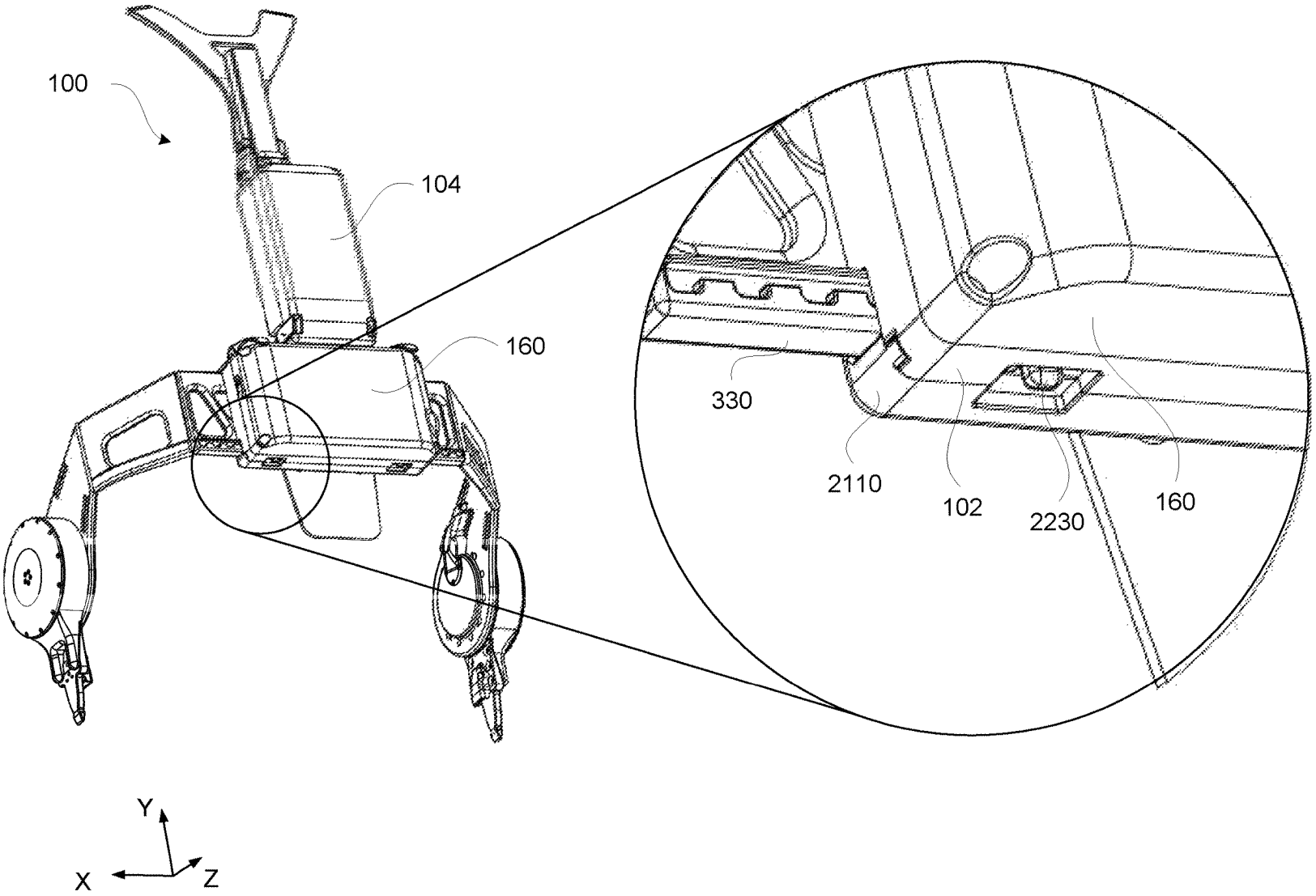
FIG. 13 illustrates an enlarged fragmentary perspective view of that shown in FIG. 12 showing notches located on the left hip frame in greater detail, in accordance with one or more embodiments.

The first hip locking mechanism may comprise adjustment notches on each hip slider. As shown in FIG. 2, right hip slider 202 and left hip slider 302 comprise right slider notches 230 and left slider notches 330, respectively. FIG. 12 is another perspective view thereof showing rear, bottom, and left sides. FIG. 13 illustrates an enlarged fragmentary perspective view of that shown in FIG. 12 showing notches 330 located on the left hip frame 300 in greater detail, in accordance with one or more embodiments.

The first hip locking mechanism may further comprise hip indexing pins, which may interlock with notches on corresponding hip sliders to secure each hip frame in a desired position. The hip indexing pins may further be released from the notches to permit the sliding motion of the hip frames. As shown in FIGS. 6, 9, 10, and 11, right hip indexing pin 2230 and left hip indexing pin 2330 are located on centerpiece 102 at the underside of assembly 100.

As shown in FIG. 13, slider notches 330 (and slider notches 230) may comprise rectangular processes with alternating rectangular grooves. It should be understood that right slider notches 230 are mirror images of slider notches 330 and comprise substantially identical components. Although rectangular processes and grooves are illustrated, it should be recognized that slider notches 330 may comprise any one of various appropriate shapes, such as triangular or circular grooves.

The hip adjustment mechanism may further comprise a second hip locking mechanism for each hip frame which further controls the sliding movement of each hip frame. In some embodiments the second hip locking mechanism may be a clamp mechanism. Right hip clamp mechanism 2200 may secure the position of right hip frame 200, and left hip clamp mechanism 2300 may secure the position of left hip frame 300. As shown in FIG. 3, left hip clamp mechanism 2300 includes left hip cam lever 2302 and left hip clamp piece 2304. As shown in FIG. 4, right hip clamp mechanism 2200 includes right hip cam lever 2202 and right hip clamp piece 2204. The clamp mechanisms may apply a downward force to urge each hip slider against lower rail 2110. As such clamp mechanisms 2200 and 2300 may work in conjunction with the slider notches to add stability and security to the movement of hip frames relative to centerpiece 102. Hip frame adjustment mechanisms incorporating slider notches 230 and 330, as well as hip clamp mechanisms 2200 and 2300, are further described with reference to FIGS. 13, and 21-25.

Notification Lights

Figure 16:
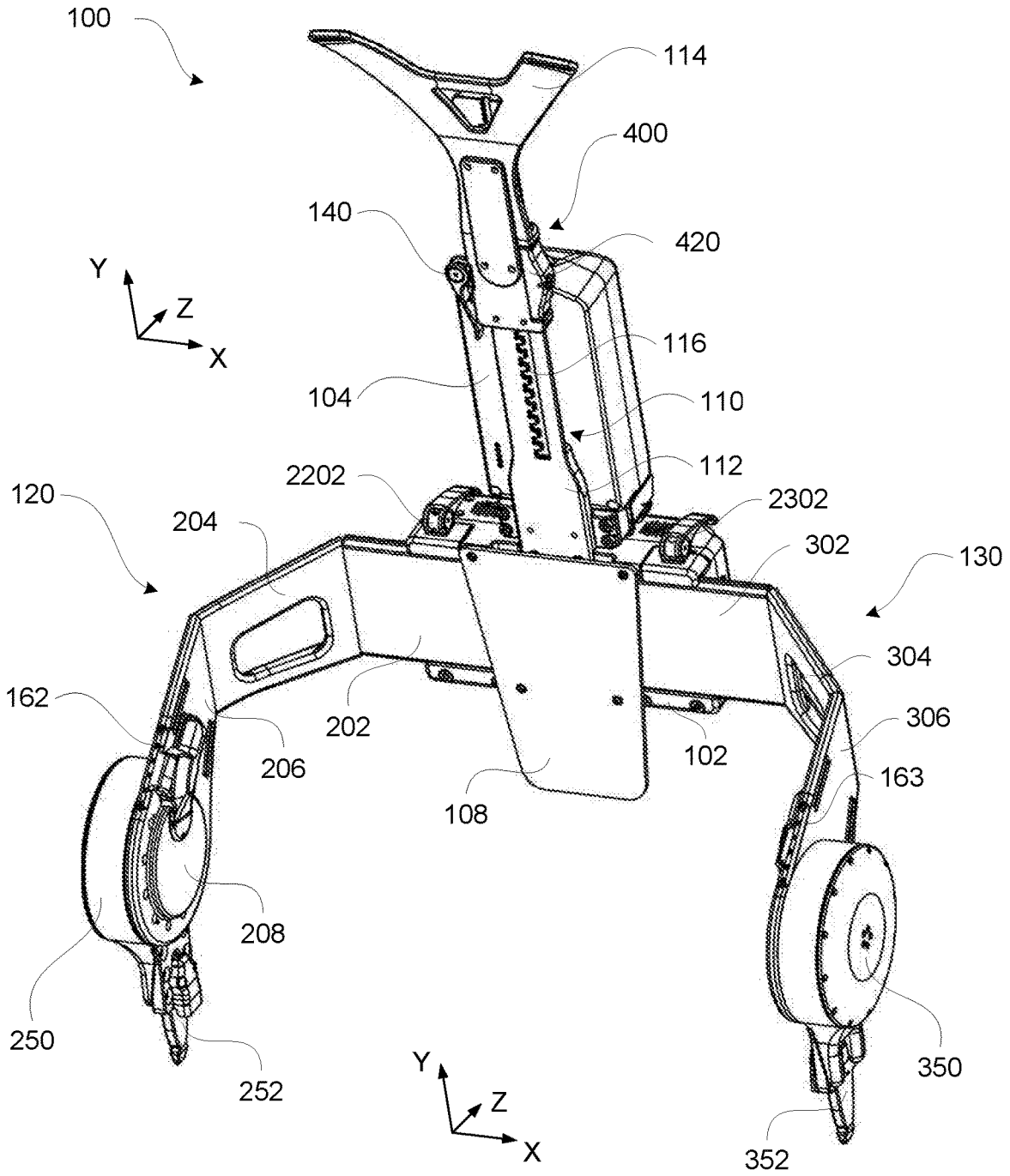
FIG. 16 illustrates a perspective view of a trunk and hip assembly for exoskeleton apparatus showing top, front, and left sides, in accordance with one or more embodiments.
Figure 17:
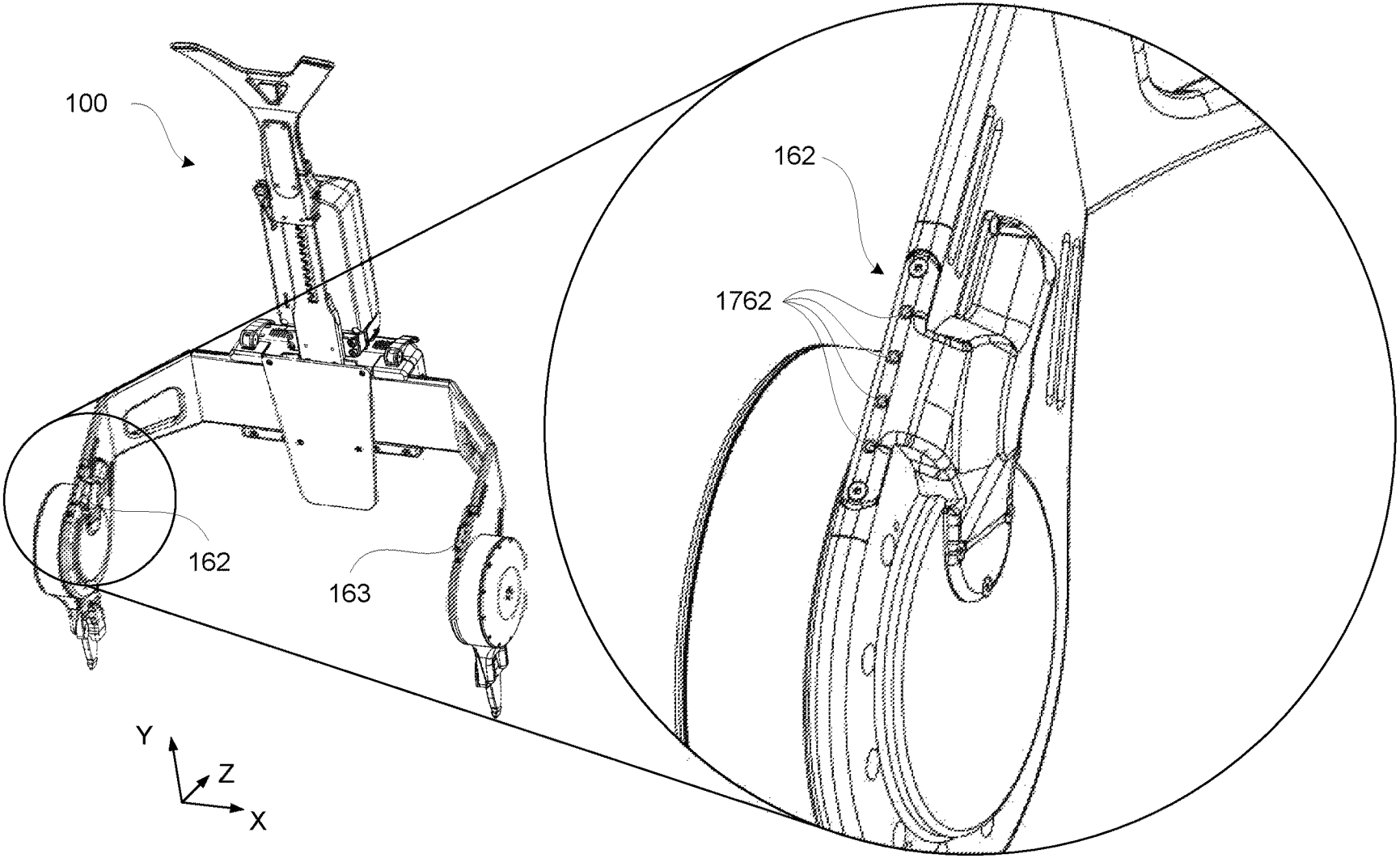
FIG. 17 illustrates an enlarged fragmentary perspective view of that shown in FIG. 16 showing a light located on the right hip frame in greater detail, in accordance with one or more embodiments.

In particular embodiments described herein, assembly 100 may further comprise one or more notification lights located at the end of each hip frame. FIG. 16 illustrates a perspective view of a trunk and hip assembly for exoskeleton apparatus showing top, front, and left sides, in accordance with one or more embodiments. FIG. 17 illustrates an enlarged fragmentary perspective view of that shown in FIG. 16 showing a light structure 162 located on the right hip frame in greater detail, in accordance with one or more embodiments.

As illustrated, right light structure 162 is located on right hip frame 200 near right motor mount plate 208, and left light structure 163 is located on left hip frame 300 near left motor mount plate 308. This placement may provide the optimal line of sight for the user, a viewer, or physical therapy professional to view the light. However, in various embodiments, light structures 162 and 163 may be located on various other locations of assembly 100. In some embodiments, additional light structures may be located on various other locations of assembly 100 in addition to light structures 162 and 163. For example, additional lighting structures may be located on electronics enclosure 160. In yet further embodiments, assembly 100 may not comprise any lights.

In some embodiments, light structures 162 and 163 may each comprise one or more individual lights. In some embodiments, light structures 162 and 163 may comprise a strip of multiple lights 1762, as depicted in FIG. 17. FIG. 17 shows an enlarged view of right light structure 162. However, it should be recognized that left light structure 163 is a symmetrical counterpart of right light structure 162 and comprises substantially similar components and configurations. In various embodiments, light structures 162 and 163 may comprise one or more light emitting diodes (LEDs). For example, each light 1762 may comprise an LED chip within a silicone lens. As another example, each light 1762 may comprise multiple LEDs configured to emit light of various colors.

Light structures 162 and 163 may comprise various functions, such as with various colors, lighting patterns, flash patterns, etc. For example, light structures 162 and 163 may provide illumination at night or in dark environments. In some embodiments, light structures 162 and 163 may indicate the operational state of assembly 100 and/or an associated exoskeleton apparatus. In some embodiments, light structures 162 and 163 may emit light of one or more colors. Each color may correspond to a particular operational state of assembly 100 and/or an exoskeleton apparatus.

For example, light structures 162 and 163 may indicate power status and or error/malfunctioning messages. In various embodiments, an exoskeleton apparatus may be in one or more of the following modes: a Standing Mode, a Walking Mode, and a Seated Mode. The Standing Mode may correspond to a state in which exoskeleton and the user are in a standing position with feet together. The Walking Mode may correspond to a state in which exoskeleton and the user are walking with motor assemblies 250 and 350 are operable to move leg attachments in a coordinated manner. The Seated Mode may correspond to a state in which the exoskeleton and the user are in a seated position. In some embodiments of the Seated Mode, the user may be seated on a suitable surface. In some embodiments of the Seated Mode, the exoskeleton may be locked in a seated position allowing the user to rest in a squatting position. In some embodiments, light structures 162 and 163 may indicate a transition between such operational modes. For example, a particular color may indicate a loading period.

Light structures 162 and 163 may indicate other operational modes including: ready to stand, ready to sit, timeout or sleep mode, power on and power off. Light structures 162 and 163 may additionally indicate the status of an attachment, such as leg assemblies 1800, to notify a user whether the attachment has been properly or securely fixed to assembly 100.

Figure 18:
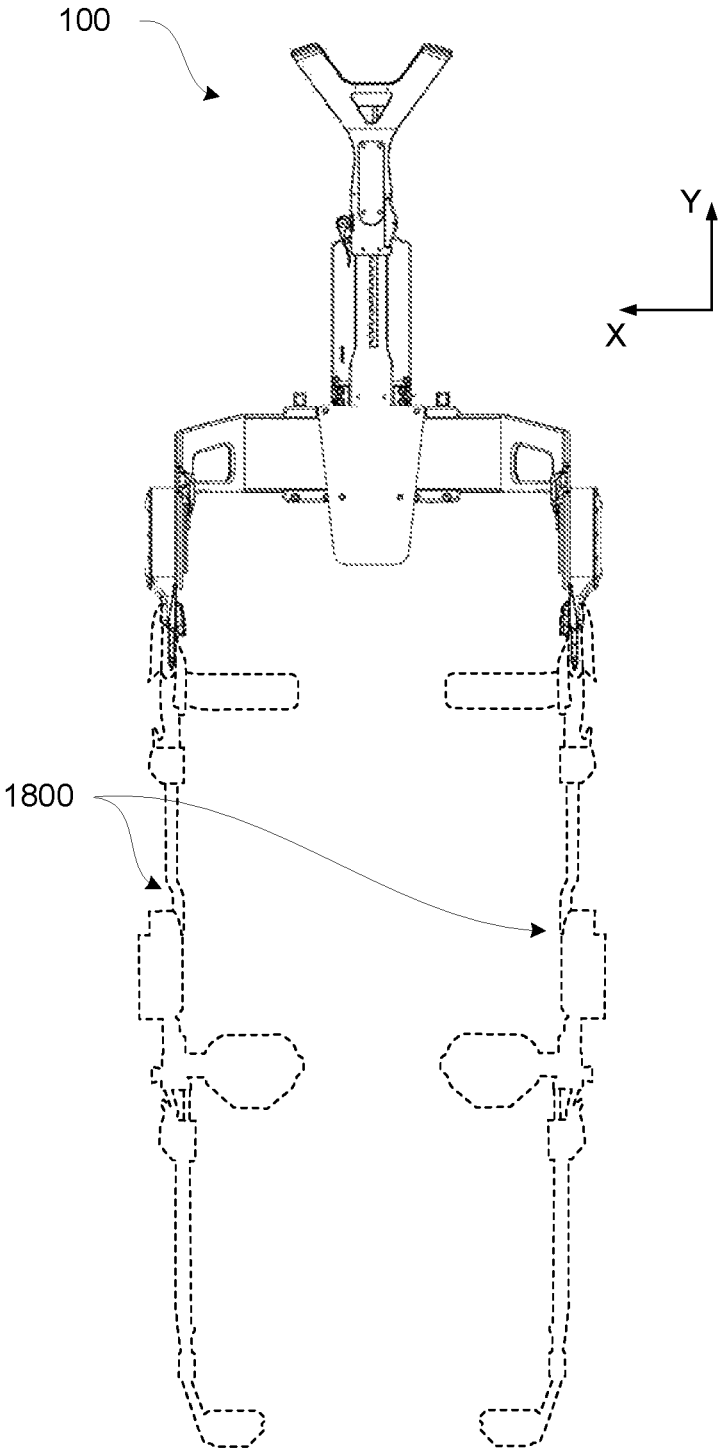
FIG. 18 is another front view of that shown in FIG. 1, depicting possible configuration of mechanical leg assemblies, in accordance with one or more embodiments.
Figure 19:
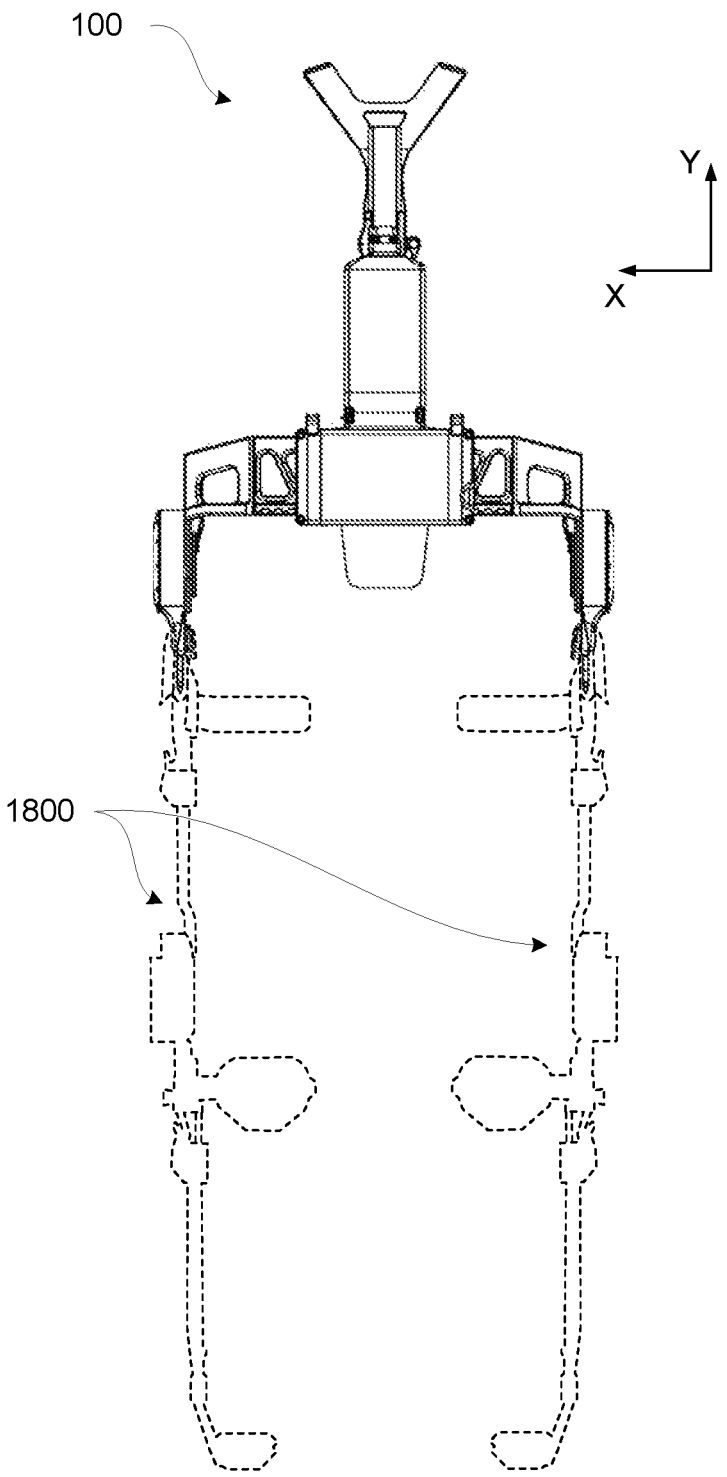
FIG. 19 is another rear view of that shown in FIG. 2, depicting possible configuration of mechanical leg assemblies, in accordance with one or more embodiments.
Figure 20:
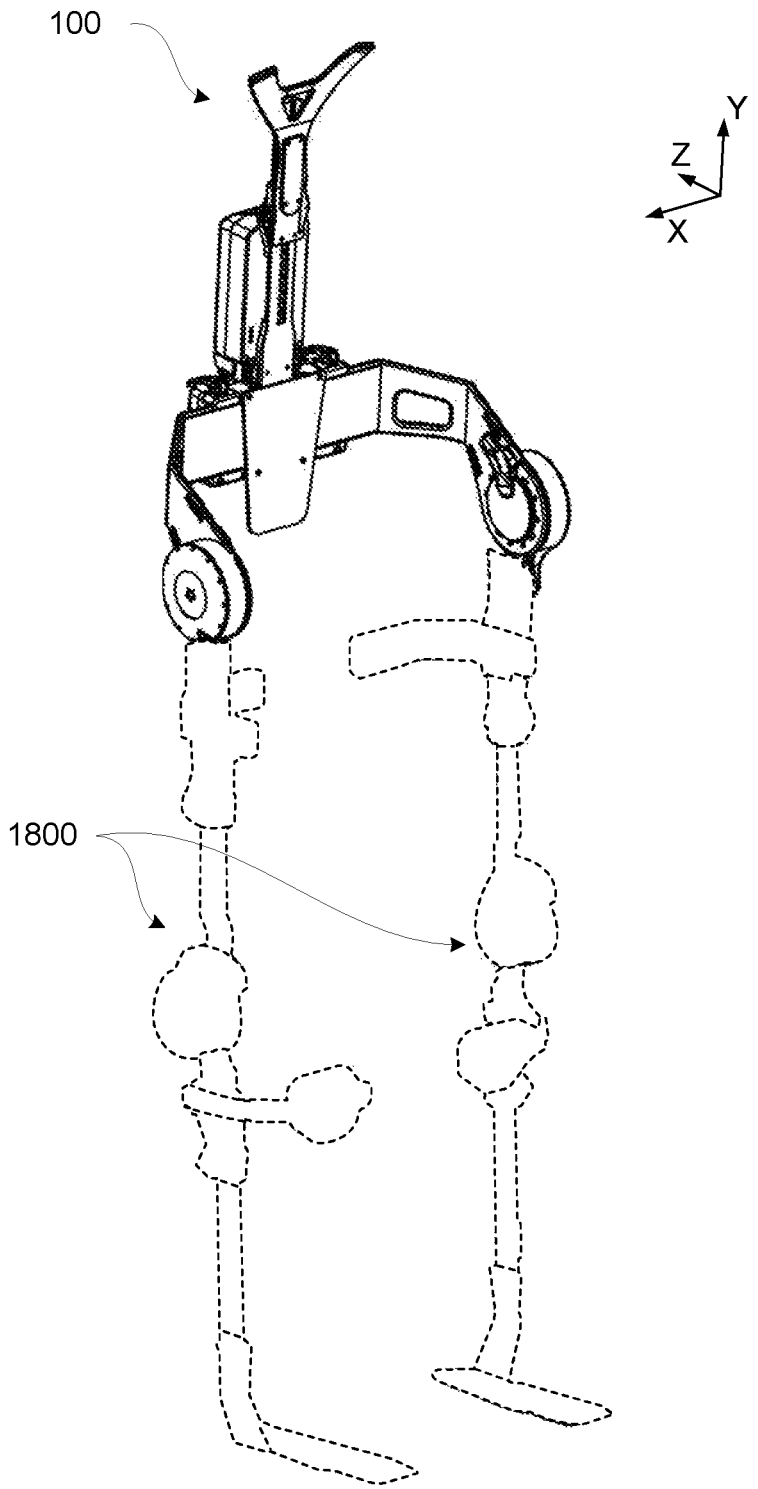
FIG. 20 is another perspective view of a trunk and hip assembly for exoskeleton apparatus showing front and right sides, depicting possible configuration of mechanical leg assemblies, in accordance with one or more embodiments.

An exoskeleton can comprise various other elements such as multiple articulating joints that allow the movement of a user's lower extremities to be closely followed by additional actuators and sensors. An example of possible configuration of mechanical leg assemblies are shown in FIGS. 18-20 below, in accordance with one or more embodiments. Various such operational states of an exoskeleton apparatus may be implemented in systems and methods described in U.S. patent application Ser. No. 13/818,338 titled ORTHESIS SYSTEM AND METHODS FOR CONTROL OF EXOSKELETONS, previously referenced above.

Leg Assembly Attachments

Each motor assembly may comprise attachment points. As illustrated, right motor assembly 250 includes a right attachment point 252, and left motor assembly 350 includes a left attachment point 352. Attachment points may serve to couple with various attachments, such as leg braces, leg supports, or other mechanical leg assemblies. FIGS. 18, 19, and 20 illustrate various perspective views of assembly 100 with mechanical leg assemblies 1800 coupled to the motor assemblies. FIG. 18 is another front view of that shown in FIG. 1, depicting possible configuration of mechanical leg assemblies, in accordance with one or more embodiments. FIG. 19 is another rear view of that shown in FIG. 2, depicting possible configuration of mechanical leg assemblies, in accordance with one or more embodiments. FIG. 20 is another perspective view of a trunk and hip assembly for exoskeleton apparatus showing front and right sides, depicting possible configuration of mechanical leg assemblies, in accordance with one or more embodiments.

Leg assemblies 1800 may comprise complementary attachment mechanisms that are configured to interlock with attachment points 252 and 352. As such, different leg assemblies 1800 may be interchangeably secured to assembly 100 based on the user's requirements, such as height and leg measurements. Various other attachments may also be configured to attach to assembly 100 via attachment points 252 and 352. Leg assemblies may form electronic connections to the main controller and battery pack via attachment points 252 and 352 to power and control movement of the leg assemblies during operation.

In various embodiments, leg assemblies 1800 may be anatomically aligned with a user's thighs, legs, and knees. Leg assemblies 1800 configured with an anthropomorphic profile and adjustable sizing may allow for natural movement and intuitive awareness of a user's position within tight spaces. In some embodiments, leg assemblies allow a user to squat repeatedly for prolonged periods of time by reducing the knee joint and quadriceps muscle forces.

In other example embodiments, leg assemblies 1800 may comprise leg braces to support a paraplegic user in standing and walking. Such bracing assemblies may comprise semi-passive knee system. In some embodiments, the main controller governs the locking and unlocking of the knee joints based on hip movements of the motor assemblies when in operation to allow support during stance and ground clearance during swing.

Leg assemblies 1800 may be configured to support various other activities, such as walking, ascending/descending stairs, and squatting to allow unimpeded locomotion and support when desired. Some embodiments of leg assemblies 1800 may comprise a locking mode, in which leg assemblies 1800 may function as a chair or other stationary load bearing support.

Hip Adjustment Mechanisms

The width between the hip frames 120 and 130 may be adjusted via a hip adjustment mechanism at each hip frame which allows hip frames 120 and 130 to slide substantially laterally relative to centerpiece 102. In various embodiments, each hip adjustment mechanism may comprise a first hip locking mechanism and a second hip locking mechanism. In some embodiments the first hip locking mechanism may comprise a hip indexing mechanism with slider notches located on each hip frame and interlocking hip indexing pins. In some embodiments, the second hip locking mechanism comprises a hip clamping mechanism to secure the positioning and stability of the moveable hip frames.

Figure 21:
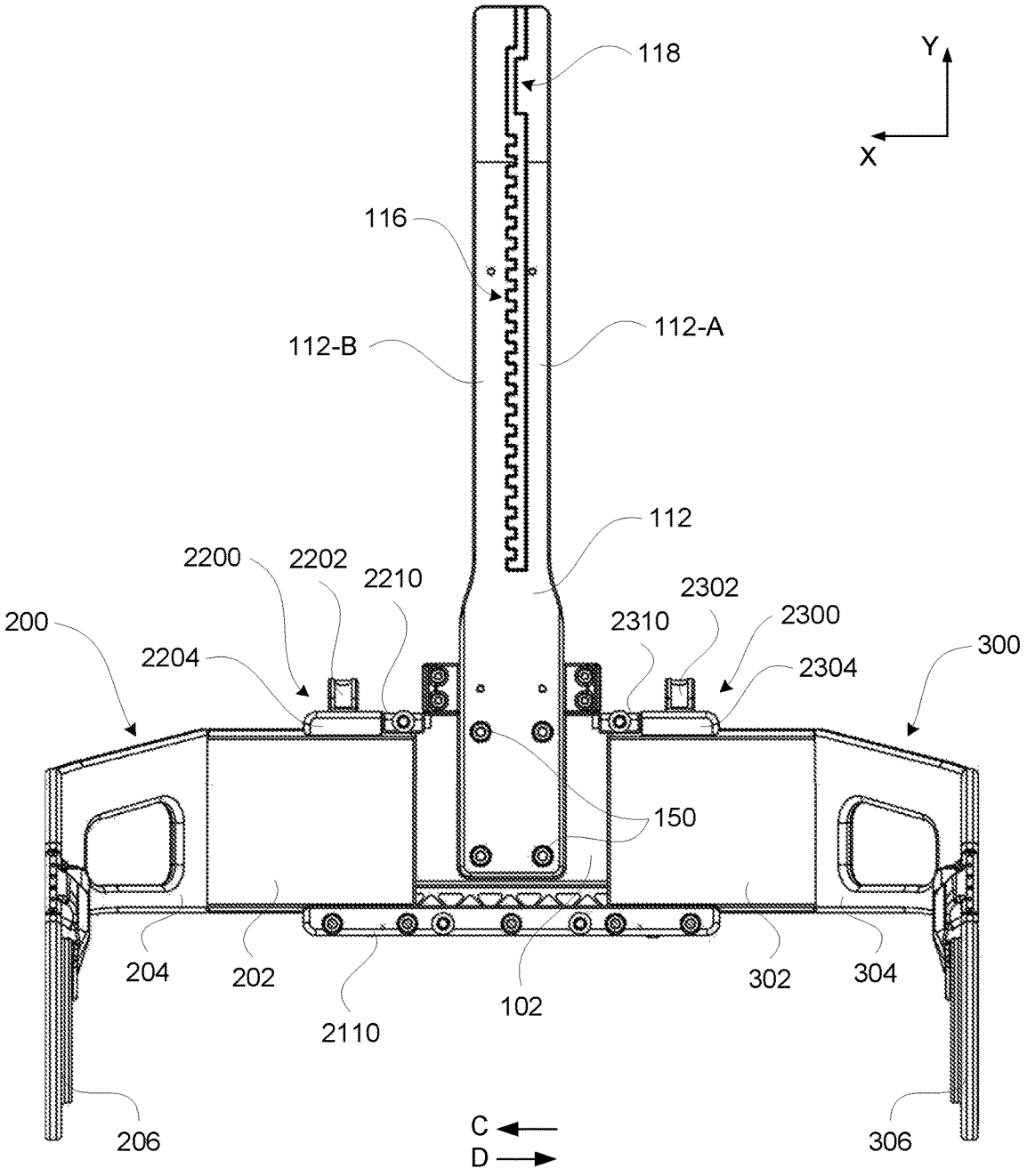
FIG. 21 illustrates an exposed front view trunk and hip assembly, in accordance with one or more embodiments.
Figure 22:
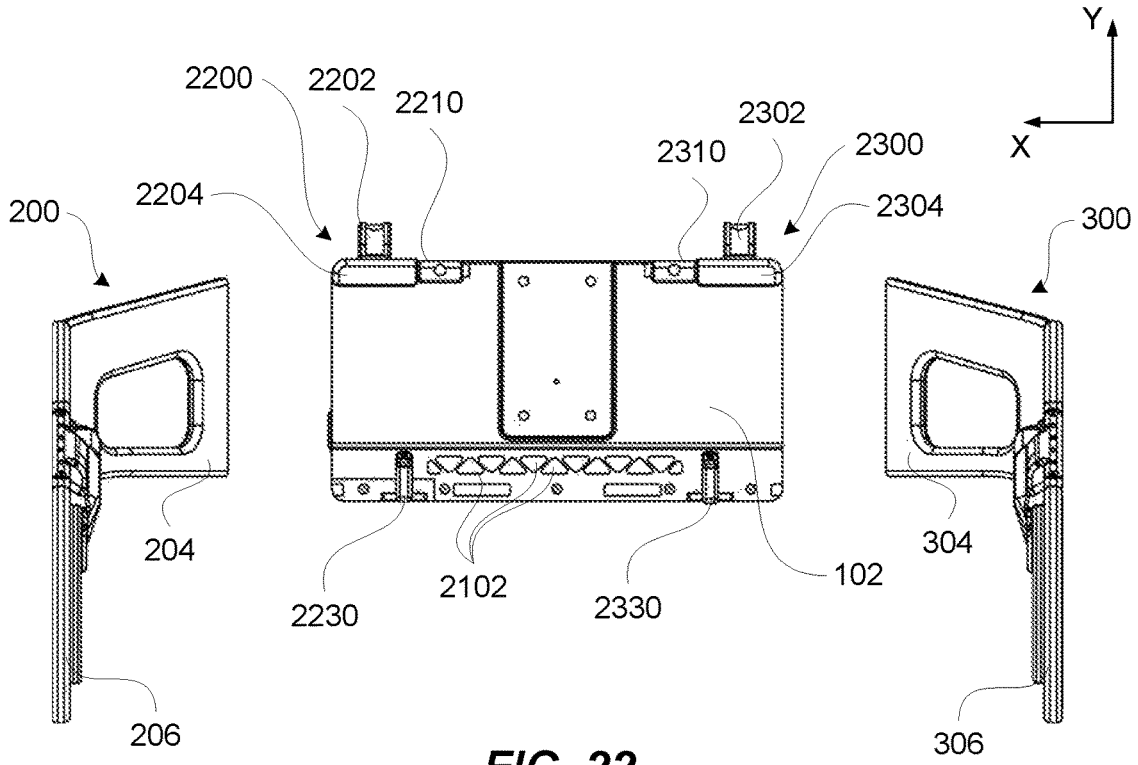
FIG. 22 illustrates an exposed front view of an assembly centerpiece and portions of hip frames, in accordance with one or more embodiments.
Figure 23:
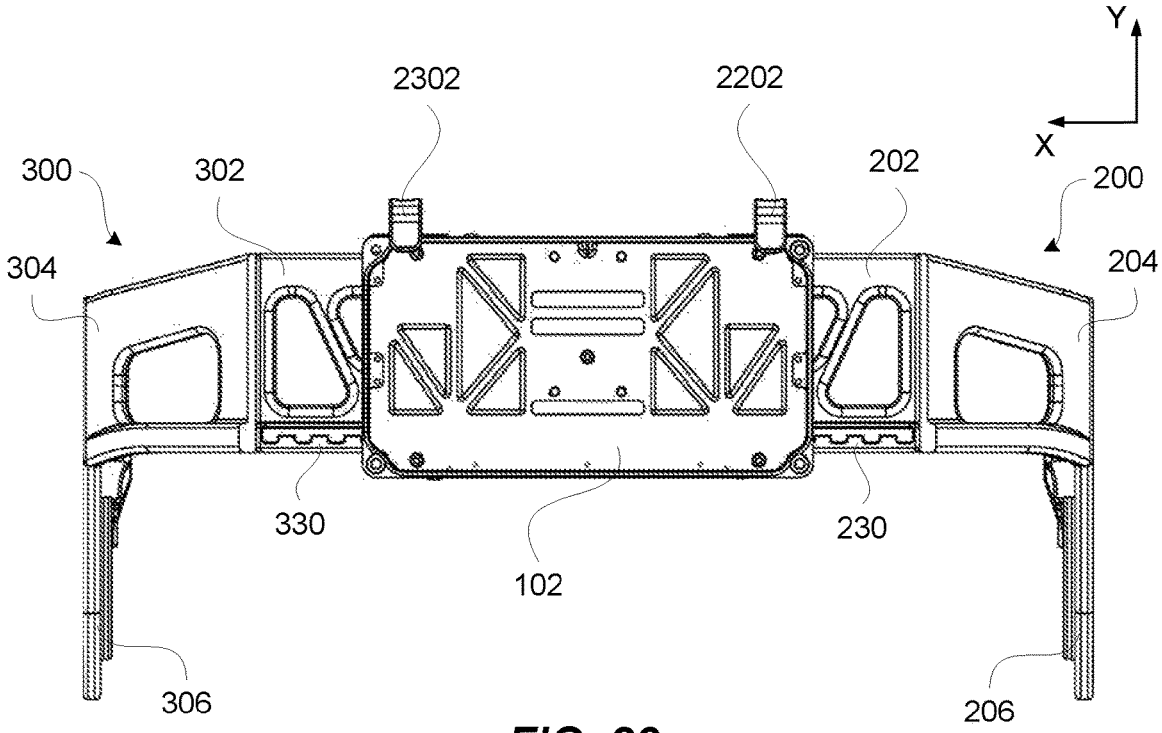
FIG. 23 illustrates an exposed rear view of an assembly centerpiece with hip frames, in accordance with one or more embodiments.
Figure 24:
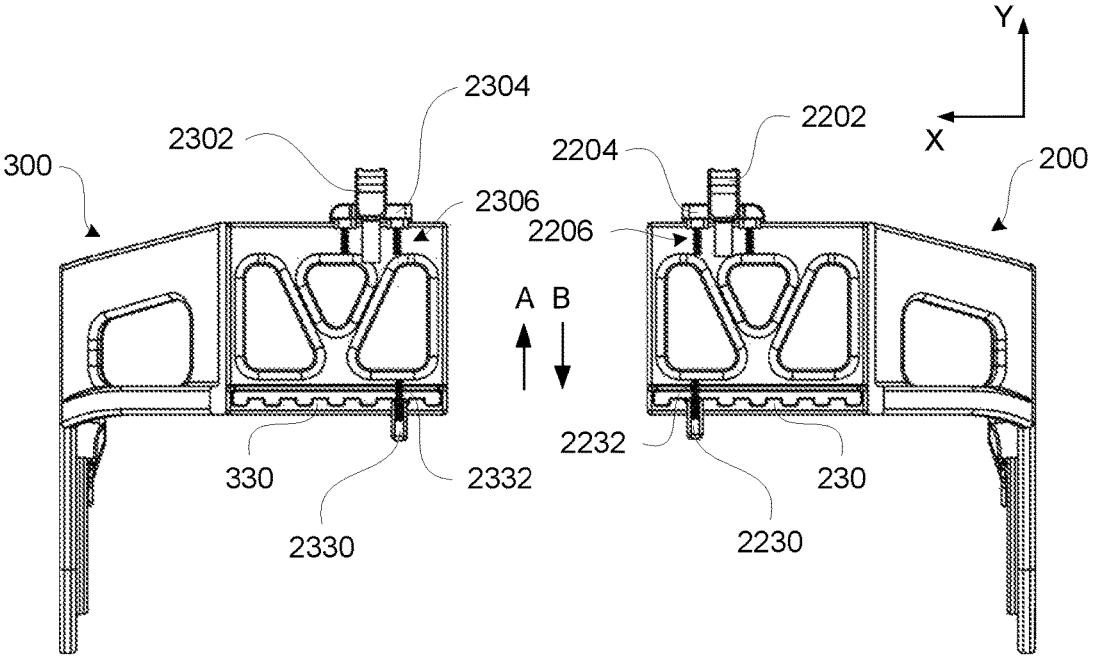
FIG. 24 illustrates a rear view of hip frames, in accordance with one or more embodiments.
Figure 25:
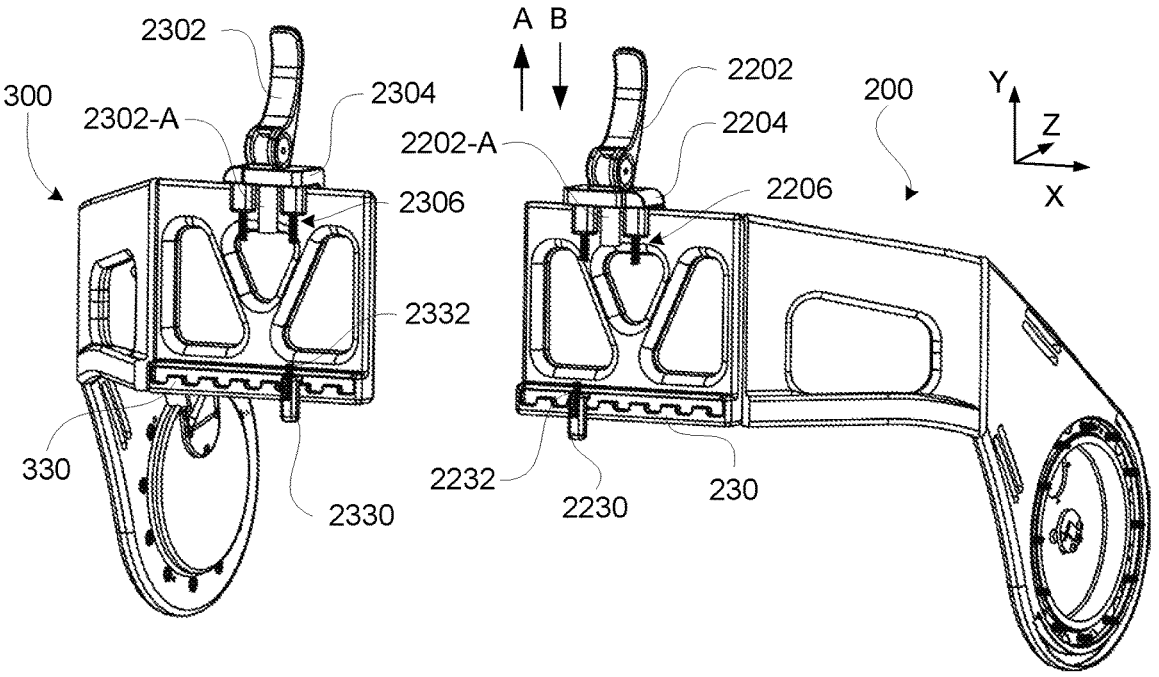
FIG. 25 illustrates a perspective view of hip frames, in accordance with one or more embodiments.

FIG. 21 illustrates an exposed front view of a trunk and hip assembly, in accordance with one or more embodiments. As illustrated in FIG. 21, the shoulder brace and sacral plate 108 have been removed. In some embodiments, spine portion 112 may be coupled to centerpiece 102 via one or more fasteners 150. In some embodiments, fasteners 150 may be any one of various fastener mechanisms, including threaded bolts, screws, welded bolts, etc. FIG. 22 illustrates an exposed front view of an assembly centerpiece and portions of hip frames, in accordance with one or more embodiments. As shown, centerpiece 102 may comprise one or more perforations 2102 to reduce the overall weight of assembly 100. FIG. 23 illustrates an exposed rear view of an assembly centerpiece with hip frames, in accordance with one or more embodiments. FIG. 24 illustrates a rear view of hip frames, in accordance with one or more embodiments. FIG. 25 illustrates a perspective view of hip frames, in accordance with one or more embodiments.

As shown, hip frames 200 and 300 are supported at corresponding hip sliders 202 and 302 via lower rail 2110, right upper rail 2210, and left upper rail 2310. Right upper rail 2210 and lower rail 2110 form a track that guides the upper and lower edges of hip slider 202 and permits right hip slider 202 to slide laterally with respect to centerpiece 102. Left upper rail 2310 and lower rail 2110 form a track that guides the upper and lower edges of left hip slider 302 and permits left hip slider 302 to slide laterally with respect to centerpiece 102. In some embodiments, the upper rails and lower rail may be coupled to centerpiece 102 via fasteners, such as fastener 150.

The position of hip frames 200 and 300 may be adjusted via a hip indexing mechanism comprising slider notches 230 and 330 and hip indexing pins. Hip indexing pins 2230 and 2330 are located on centerpiece 102. Each hip indexing pin may comprise a horizontal portion which is configured to fit within a groove of the slider notches. Right hip indexing pin 2230 is configured to interlock with grooves of the right slider notches 230 and left hip indexing pin 2330 is configured to interlock with grooves of the left slider notches 330. The position in which the indexing pin interlocks with the grooves may be referred to herein as the "interlocked position." The hip indexing pins may be configured to move in the directions of arrows A and B between an unlocked position and a locked position of the first hip locking mechanism.

In the downward position, each hip indexing pin may be interlocked within a groove of the slider notches in the respective hip frame. In the locked position, hip indexing pins 2230 and 2330 may be urged downward in the direction of arrow B to keep hip indexing pin in the interlocked position via a respective spring mechanisms 2232 and 2332. FIG. 24 illustrates the indexing pins in the locked position. In such a position, the hip frames may be secured into the corresponding lateral position.

Each insert can be released from a groove by an upward force into the unlocked position, which may be provided by a user manually. FIG. 25 illustrates the hip indexing pins in an unlocked position and released from the grooves of notches 230 and 330. Once released, the hip frames can be moved laterally to a desired position and width. The upward pressure on the hip indexing pins may then be removed to allow the hip indexing pins to be urged downward again into an aligned groove of the respective slider notches. In the embodiment described above, the unlocked and locked position of the indexing pin corresponds to the unlocked and locked position of the first hip locking mechanism.

As illustrated, each set of slider notches includes seven grooves. However, it should be understood that additional or fewer grooves may be included on each hip frame. For example, additional grooves of smaller lengths may be included for finer increments of adjustability. For example, the distance between each groove in notches 230 and 330 may be approximately 15 millimeters.

In some embodiments, a second hip locking mechanism may comprise a hip clamp mechanism which further secures the hip frames in place. In some embodiments, the second hip locking mechanism comprises a hip clamping piece coupled to a hip cam lever wherein the hip cam lever and the hip clamping piece are configured to create friction force between the side hip frame and the centerpiece 102 when the second locking mechanism is in the locked position. In the locked position, the friction force prevents any sliding motion between the side hip frame and the centerpiece 102 hip frame.

As shown in FIG. 21, hip clamp pieces may be positioned adjacent to each upper rail and configured to function as a continuation of the upper track space formed by the upper rails 2210 and 2310. Right hip clamp piece 2204 is positioned adjacent to right upper rail 2210 and left hip clamp piece 2304 is positioned adjacent to left upper rail 2310. The position of hip clamp piece 2204 and 2304 relative to the hip frames in direction A and B is controlled by the geometry of the hip cam levers 2202 and 2302 cam profile. When the cam is in the locked position, or closed position, each hip clamp piece 2204 and 2304 may be urged downward in the direction of arrow B, into a constrained position, creating friction force between hip frames and the lower rail 2110.

As shown in FIGS. 24 and 25, in some embodiments each hip clamp piece 2204 and 2304 may be urged upward in the direction of arrow A into a lax position via respective spring mechanisms 2206 and 2306. Hip cam levers 2202 and 2302 may be configured to operate in an open position and a closed position. In FIG. 25, hip cam levers 2202 and 2302 are shown in the open position, while hip cam levers 2202 and 2302 are shown in the closed position in FIGS. 21-24. Hip cam levers 2202 and 2302 may be secured to the centerpiece by pins 2202-A and 2302-A, respectively. Each pin 2202-A and 2302-A may pass through the hip clamp pieces and couple to cam inserts of hip cam levers 2202 and 2302. In some embodiments, hip cam levers 2202 and 2302 may be spiral cam levers which may comprise an eccentric lever that moves along a logarithmic spiral. When rotating about a center axis, the hip cam levers may transform the rotary motion into linear motion against the hip clamp pieces in the directions of arrows A and B.

When the hip cam levers are in the open position, clamp pieces are able to be urged into the lax position by spring mechanisms 2206 and 2306. This corresponds to the unlocked position of the second hip locking mechanism. When the hip cam levers are in the closed position, the hip cam levers urge the respective hip clamp pieces downward in the direction of arrow B into a constrained position. This corresponds to the locked position of the second hip locking mechanism. In the constrained position, the hip clamp pieces are urged against the hip frames causing the hip frames to be compressed between the hip clamp pieces and a lower rail 2110. This compression may cause friction to keep the hip frames in place even when hip indexing pins 2230 and 2330 are released. Thus, in order to adjust the spacing of the hip frames, hip cam levers 2202 and 2302 must be first released to allow spring mechanisms to urge the hip clamp pieces upward to relieve compression from the hip frames.

As depicted, spring mechanisms 2206 and 2306 comprise two springs acting on hip clamp pieces 2204 and 2304, respectively. However, spring mechanisms 2206 and 2306 may be configured to comprise more or fewer springs. Similarly, spring mechanisms 2232 and 2332 may be configured to comprise more or fewer springs acting on hip indexing pins 2230 and 2330, respectively. In some embodiments, the hip adjustment mechanism may not include spring mechanisms 2206 and 2306.

Spine Adjustment Mechanism

The length of adjustable spine assembly 110 may be adjusted by sliding shoulder brace 114 substantially vertically, in the directions of arrows A and B, relative to base portion 112. In various embodiments, spine adjustment mechanism 400 may comprise a first spine locking mechanism. First spine locking mechanism may comprise spine notches 116 located on base portion 112 and an interlocking spine indexing pin 2800. Spine adjustment mechanism 400 may further comprise a second spine locking mechanism, such as a spine clamp mechanism to secure the positioning and stability of shoulder brace 114 to base portion 112.

Figure 26:
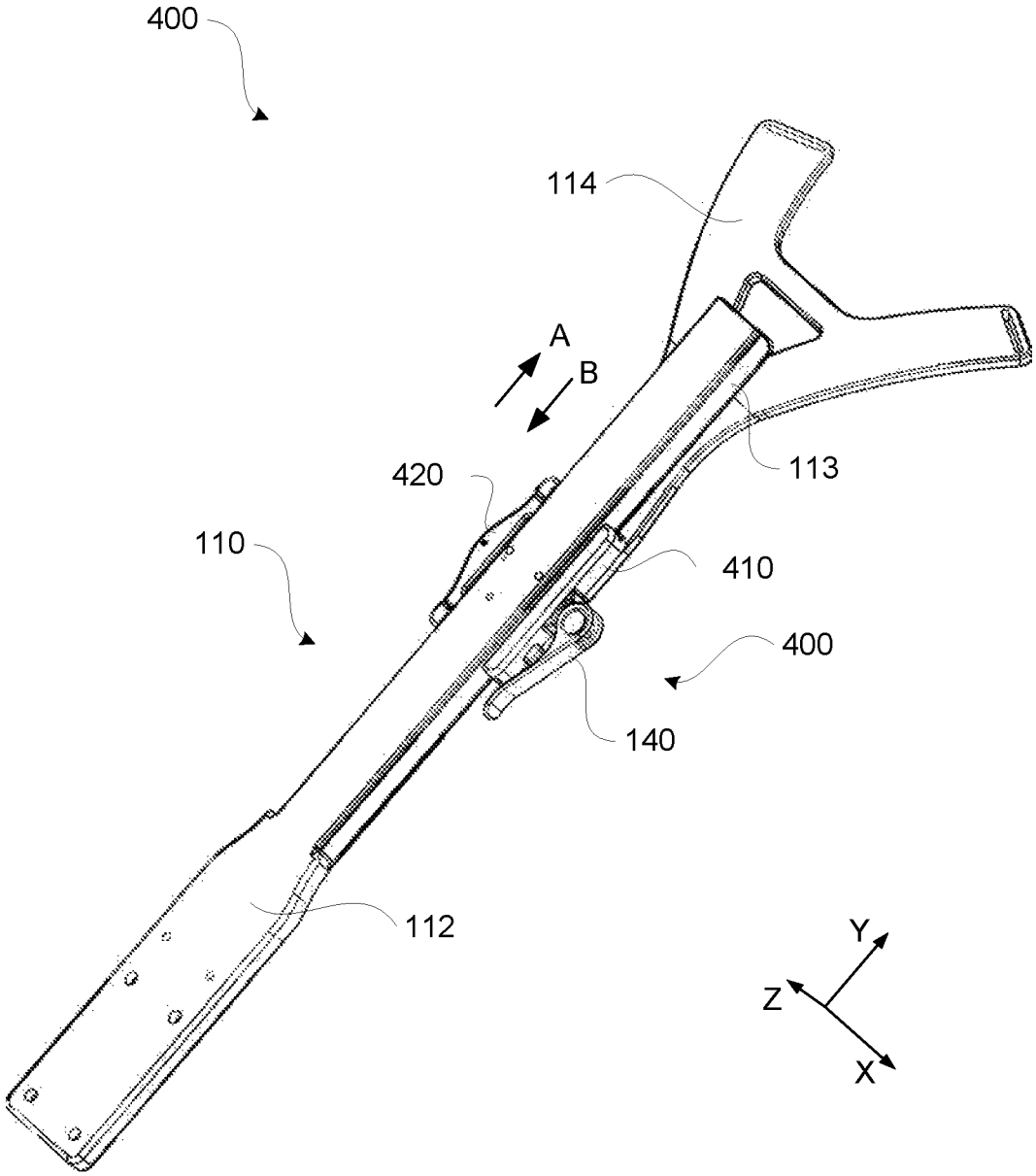
FIG. 26 illustrates a perspective view of a spine assembly of a trunk and hip assembly, in accordance with one or more embodiments.
Figure 27:
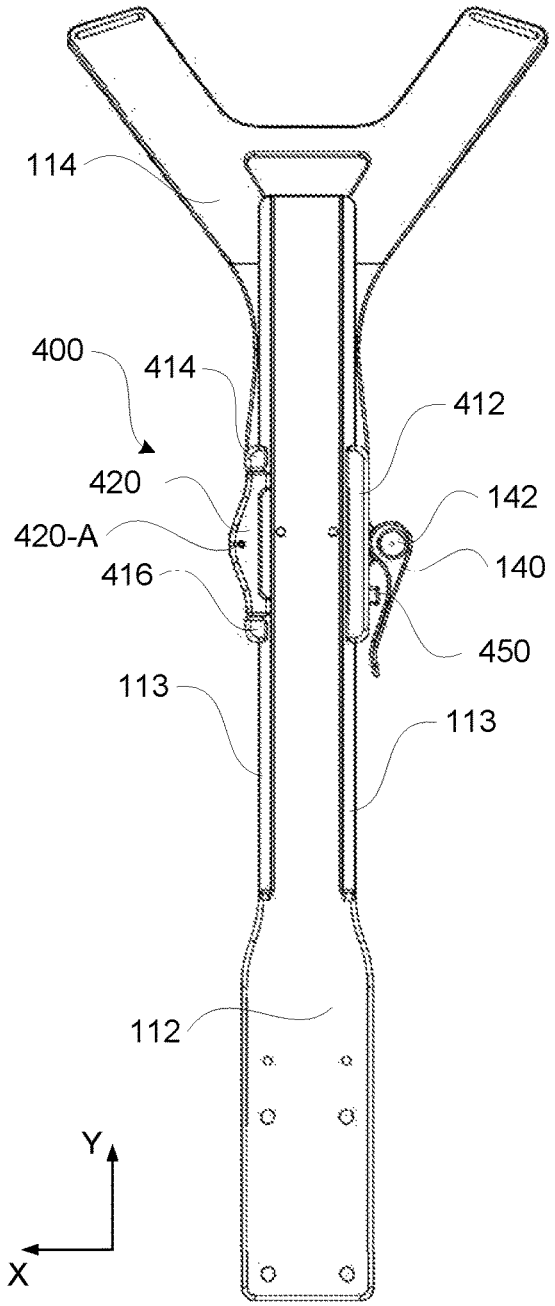
FIG. 27 is a rear view thereof.
Figure 28:
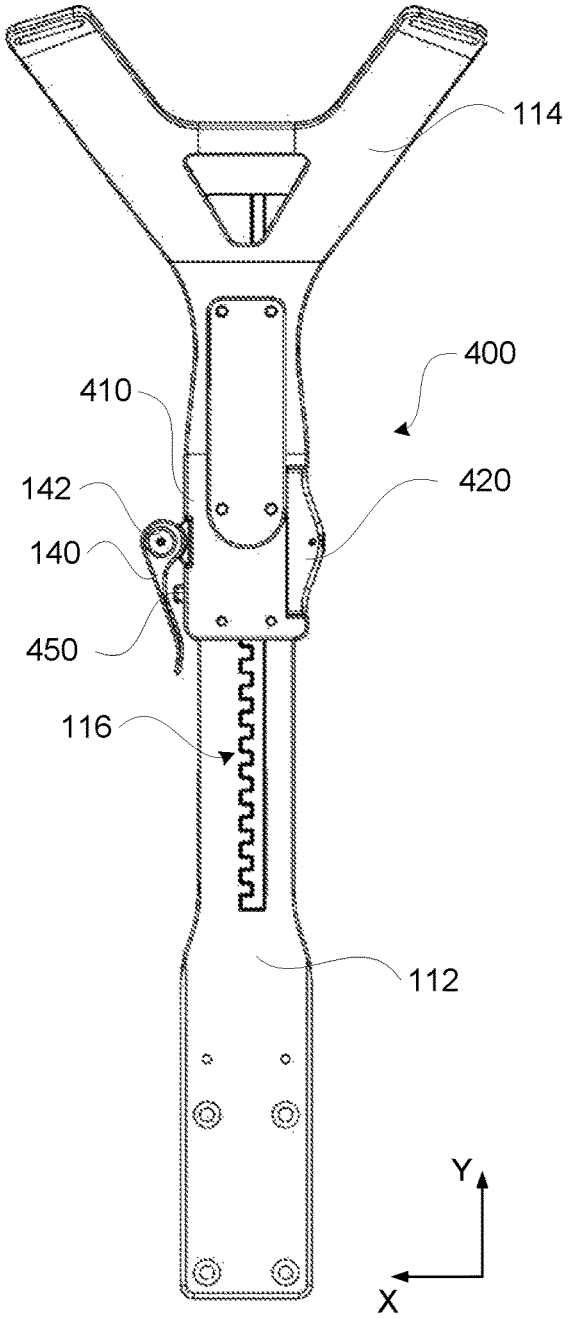
FIG. 28 is a front view thereof.
Figure 29:
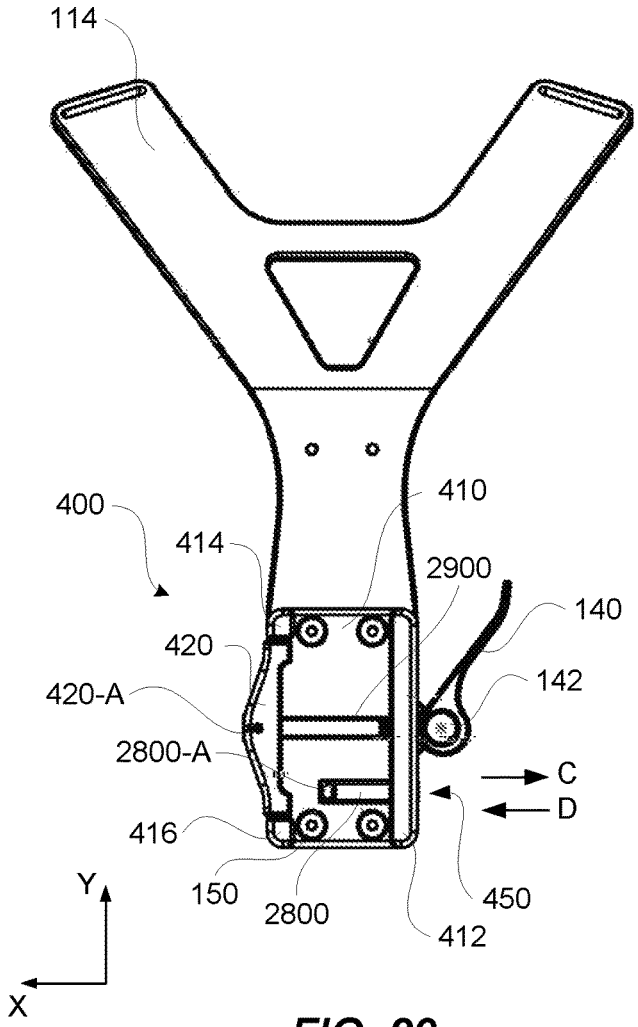
FIG. 29 illustrates an exposed rear view of a spine adjustment mechanism of a trunk and hip assembly, in accordance with one or more embodiments.
Figure 30:
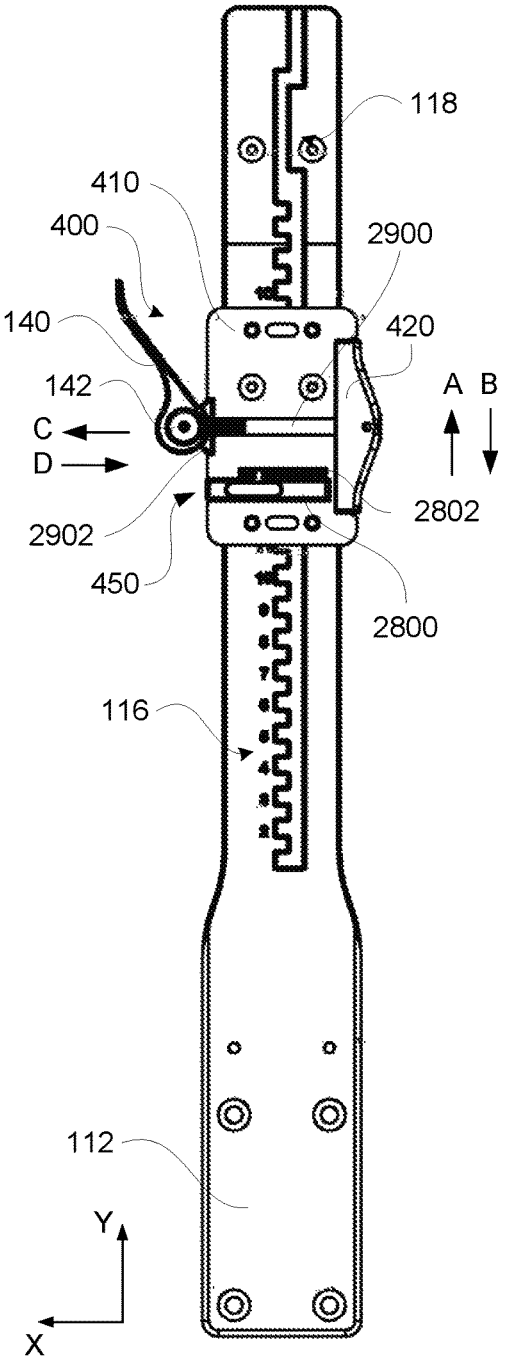
FIG. 30 illustrates an exposed front view of a spine adjustment mechanism of a trunk and hip assembly, in accordance with one or more embodiments.
Figure 31:
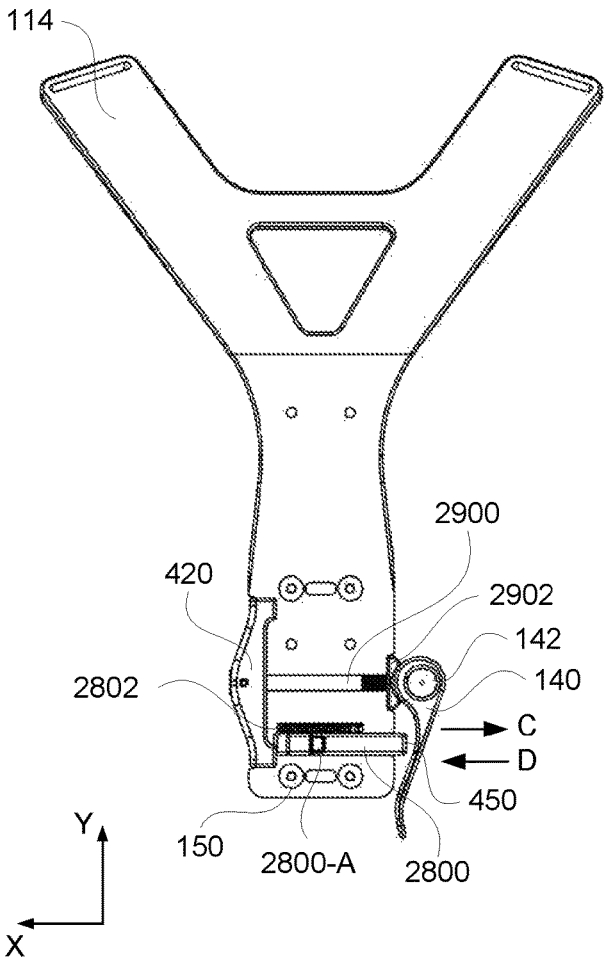
FIGS. 31 and 32 illustrate additional components of a clamp mechanism of a shoulder brace of a trunk and hip assembly, in accordance with one or more embodiments.
Figure 32:
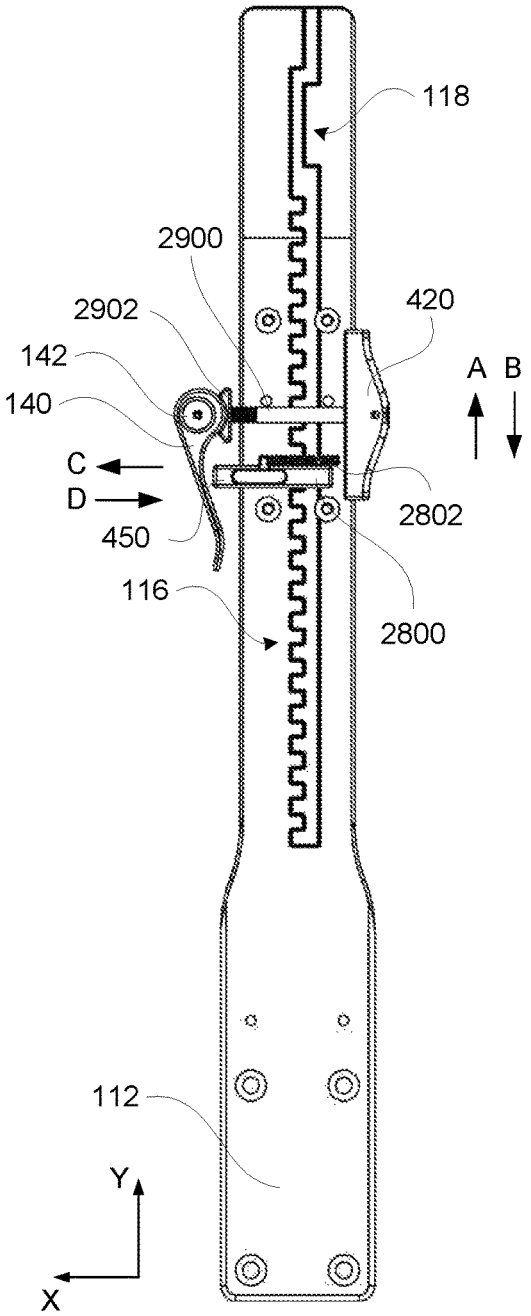

FIGS. 26-32 illustrate various views of spine adjustment mechanism 400. FIG. 26 illustrates a perspective view of a spine assembly of a trunk and hip assembly, in accordance with one or more embodiments. FIG. 27 is a rear view thereof. FIG. 28 is a front view thereof. FIG. 29 illustrates an exposed rear view of a spine adjustment mechanism of a trunk and hip assembly, in accordance with one or more embodiments. FIG. 30 illustrates an exposed front view of a spine adjustment mechanism of a trunk and hip assembly, in accordance with one or more embodiments. FIGS. 31 and 32 illustrate additional components of a clamp mechanism of a shoulder brace of a trunk and hip assembly, in accordance with one or more embodiments. FIG. 31 depicts a rear view, while FIG. 32 depicts a front view.

As can be seen in FIG. 21 base portion 112 includes a channel configuration between two surface structures 112-A and 112-B. The cavity between the two surface structures may be configured to form a series of rectangular notches 116. As shown in FIG. 15, notches 116 may comprise rectangular processes 116-A of surface structure 112-B with alternating rectangular grooves 116-B. The space between the two surface structures may also form a shoulder brace insert area 118 (shown in FIG. 21) where components of the shoulder brace 114 and spine adjustment mechanism 400 may be inserted or removed. In some embodiments brace insert area 118 may be configured with offset passages such that the spine adjustment mechanism 400 may not be inserted or removed by vertical movement alone. This allows adjustment of the length of the spine, without concern for unwanted disassembly of base portion 112 relative to the shoulder brace 114. In some embodiments, such offset configuration may interact with spine indexing pin 2800. For example, spine indexing pin 2800 may need to be alternated between a locked position and an unlocked position, as further described below, in order to maneuver the spine adjustment mechanism onto base portion 112.

The spine adjustment mechanism may comprise a first spine locking mechanism such as the spine indexing mechanism. The position of shoulder brace 114 may be adjusted via a spine indexing mechanism comprising slider body 410. In various embodiments, slider body 410 may be secured to shoulder brace 114 via fasteners 150. Slider body 410 further comprises rail portions including rail 412 and opposite rails 414 and 416. Such rails may form a track configured to guide edges 113 of base portion 112 and permit shoulder brace 114 to slide vertically in the directions of arrows A and B. As such, rails 412, 414, and 416 may secure shoulder brace 114 onto base portion 112 and limit movement to the vertical adjustment motion.

The spine indexing mechanism may further comprise spine notches 116 and spine indexing pin 2800, shown in FIGS. 29-32. As illustrated in FIG. 30, spine notches 116 may be numbered to indicate the position of spine indexing mechanism. Spine indexing pin 2800 may be coupled to and house within slider body 410. Spine indexing pin 2800 may comprise a horizontal portion 2800-A which is configured to fit within a groove of spine notches 116. Indexing pin 2800 may be configured to move in the direction of arrows C and D between a locked position and an unlocked position. FIGS. 29 and 30 show spine indexing pin 2800 in an unlocked position. FIGS. 31 and 32 show spine indexing pin 2800 in a locked position. In the embodiment of the spine indexing mechanism of FIG. 29-32, the locked and unlocked position of the spine indexing pin 2800 correspond to the locked and unlocked positions, respectively, of the first spine locking mechanism.

In the locked position, spine indexing pin 2800 may be interlocked within a groove of spine notches 116, also referred to as the interlocked position. Spine indexing pin 2800 may be urged in the direction of arrow C into the locked position by spring mechanism 2802, such that indexing pin 2800 lies in rectangular groove 116-B. In such a position, the shoulder brace 114 may be secured into the corresponding vertical position.

Spine indexing pin 2800 may be released from a groove of spine notches 116 by a force opposite to that of spring mechanism 2802 in the direction of arrow D. This opposite force may be provided by a user manually. For example, spine indexing pin 2800 may comprise a button portion 450 which protrudes from slider body 410, as shown in FIGS. 31 and 32. In some embodiments, button portion 450 may be an integral portion of spine indexing pin 2800. A user may press button portion 450 inward (arrow D) to force spine indexing pin 2800 into the unlocked position, as shown in FIGS. 29 and 30.

Once released, shoulder brace 114 may be moved vertically relative to base portion 112 into a desired position changing the length of the adjustable spine to fit the length of the torso of a particular user such that the shoulder brace rests upon the user's shoulders around the neck. The pressure on spine indexing pin 2800, applied by the user, may then be removed to allow the indexing pin to be urged again into an aligned groove of the spine notches. In various embodiments, base portion 112 may comprise additional or fewer grooves. For example, additional grooves of smaller lengths may be included for finer increments of adjustability. As an example, the distance between each groove in notches 116 may be approximately 10 millimeters.

In some embodiments, the spine adjustment mechanism may further comprise a second spine locking mechanism. In some embodiments, the second spine locking mechanism comprises a spine clamp mechanism. This spine clamp mechanism provides additional clamping force to further secure shoulder brace 114 to base portion 112 in a desired position. The spine clamp mechanism may comprise spine cam lever 140, dowel pin 142, spine clamp piece 420, threaded dowel 2900, and bearing 2902. Spine clamp piece 420 may be located between rails 414 and 416, and may also be configured with a track-like structure aligned with that of rails 414 and 416. As such, edge 113 of base portion 112 may also be partially guided through spine adjustment mechanism via clamp piece 420.

Spine clamp piece 420 may be coupled to spine cam lever 140 via threaded dowel 2900. Threaded dowel 2900 may be secured at one end to spine clamp piece 420 at attachment point 420-A. Threaded dowel 2900 may be secured at an opposite threaded end to dowel pin 142 of spine cam lever 140. Dowel pin 142 may be positioned at the center of spine cam lever 140 about the axis of rotation, and may comprise a threaded opening through which the threaded end of dowel 2900 is secured.

Dowel 2900 may run through bearing 2902 which is positioned between spine cam lever 140 and slider body 410. In some embodiments bearing 2902 may be secured to slider body 410. Bearing 2902 includes a curved surface adjacent to spine cam lever 140, which allows spine cam lever to rotate about the axis of rotation between an open position and a closed position. FIGS. 29 and 30 show spine cam lever 140 in an open position. FIGS. 26-28, 31, and 32 show spine cam lever 140 in a closed position. When rotating about the axis of rotation, spine cam lever 140 may transform the rotary motion into linear motion in the directions of arrows C and D.

When spine cam lever 140 is moved from the open position to the closed position, it may cause the distance between dowel pin 142 and slider body 410. This may apply a force on dowel 2900 in the direction of arrow C thereby pulling spine clamp piece 420 toward spine cam lever 140 in the direction of arrow C. This force urges spine clamp piece 420 into a constrained position against edges 113 of base portion 112 causing base portion 112 to be compressed between spine clamp piece 420 and rail 412. This compression creates a stabilizing frictional force between shoulder brace 114 and base portion 112, thus keeping shoulder brace 114 in place on base portion 112, even when spine indexing pin 2800 is released in the unlocked position. This may correspond to a second mode of spine adjustment mechanism 400.

When spine cam lever 140 is moved from the closed position to the open position, the compression and friction forces against base portion 112 are removed, and shoulder brace 114 is free to slide along base portion 112 upon unlocking of spine indexing pin 2800. This may correspond to a first mode of spine adjustment mechanism 400. In some embodiments, spine clamp piece 420 may be urged away from base portion 112 by a spring mechanism.

Method of Operation

Figure 33:
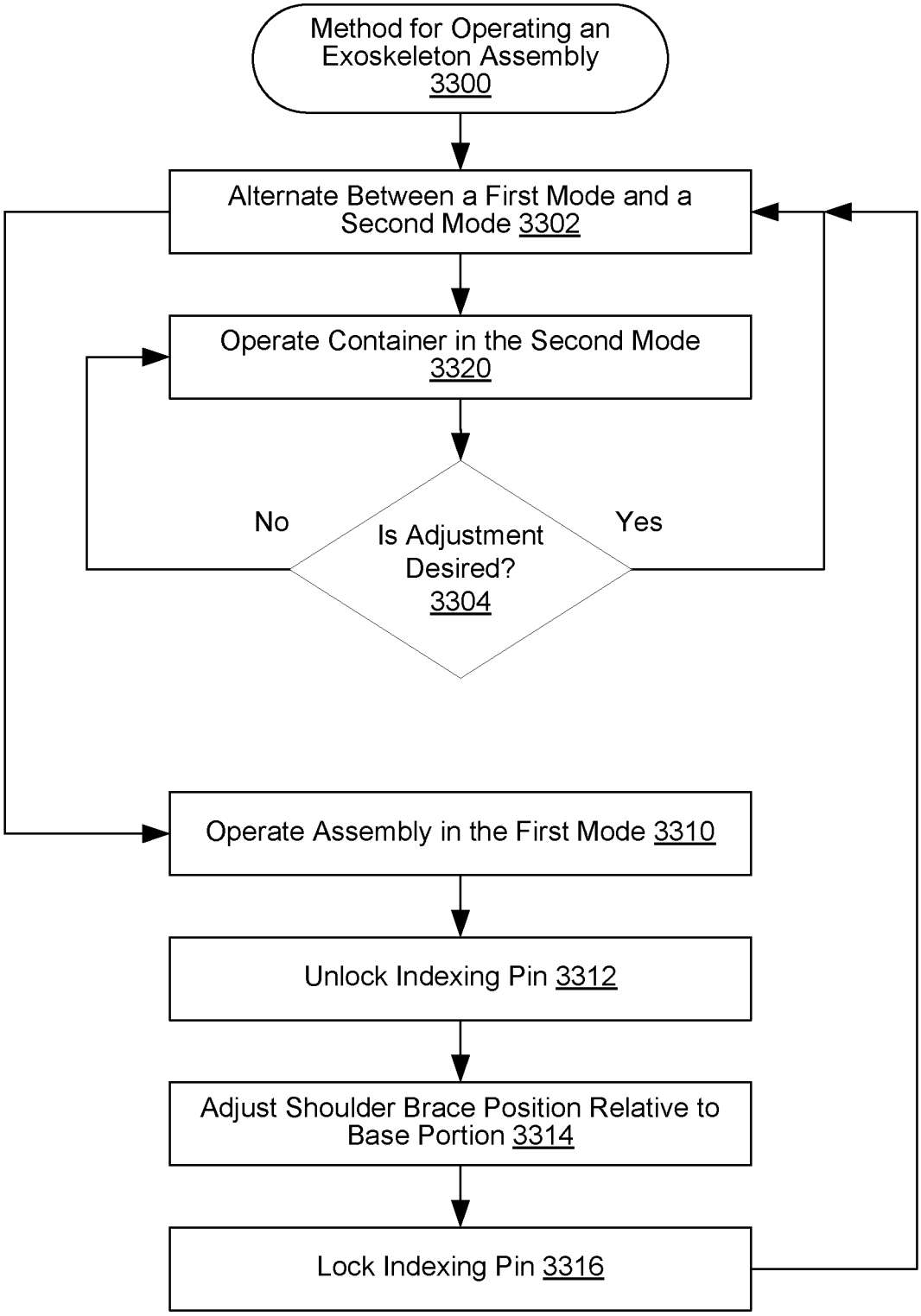
FIG. 33 illustrates a flow process corresponding to an example method for operating an exoskeleton assembly, in accordance with one or more embodiments.

FIG. 33 illustrates a flow process corresponding to an example method 3300 for operating an exoskeleton assembly, in accordance with one or more embodiments. As previously described, an exoskeleton assembly to be operated in a manner consistent with method 3300, such as assembly 100, may comprise a centerpiece with a vertical spine portion 110 including a spine adjustment mechanism, and one or more hip frames 200 and 300, each including a hip adjustment mechanism.

At operation 3302, the exoskeleton assembly may be alternated between a first mode and a second mode. In various embodiments, in the first mode, a user may adjust the length of the spine portion to fit the particular user's torso. In some embodiments, the width of the hip frames may also be adjusted to fit the particular user's hips in the first mode. In various embodiments, in the second mode, the user may secure the spine portion in a desired position. In some embodiments, the position of hip frames may also be secured in the second mode.

In some embodiments, alternating between the first mode and the second mode includes shifting a cam lever, such as spine cam lever 140, between an open position and a closed position, respectively. Spine cam lever 140 may be released to an open position at operation 3302 to operate the assembly 100 in the first mode at operation 3310. As previously described, when transitioning from the closed position to the open position, the distance between dowel pin 142 and slider body 410 may be decreased, which releases the pulling force on spine clamp piece 420. As such, the clamping forces applied by spine adjustment mechanism 400 on base portion 112 are removed.

In the first mode, a spine indexing pin is unlocked at operation 3312. For example, force may be applied to spine indexing pin 2800 in the direction of arrow D to put spine indexing pin 2800 into an unlocked position by shifting horizontal portion 2800-A out of a groove 116-B of notches 116.

With the spine indexing pin 2800 in the unlocked position, the position of shoulder brace 114 may be adjusted relative to base portion 112 at operation 3314. As previously described, the track formed by spine clamp piece 420, and rails 412, 414, and 416, guides the vertical movement of shoulder brace 114 in the direction of arrows A and B. As such, a user may adjust adjustable spine assembly 110 to a desired length. Adjustment of the shoulder brace will cause other notches 116-B to align with spine indexing pin 2800.

At operation 3316, spine indexing pin 2800 may be released back into the locked position. In the locked position, horizontal portion of 2800-A may be interlocked within another aligned notch 116-B to secure the adjusted position of shoulder brace 114.

In some embodiments, the first mode may also correspond to the release of hip cam levers 2202 and 2302 of hip adjustment mechanisms to open positions at operation 3312. As previously described, when hip cam levers 2202 and 2302 are in the open position, the clamping forces applied by respective hip clamp pieces 2204 and 2304 are released. Hip indexing pins 2230 and 2330 may then be unlocked at operation 3314 to shift the horizontal portions out of the grooves of slider notches 230 and 330.

With the hip indexing pins 2230 and 2330 in the unlocked position, the position of the hip frames may be adjusted relative to centerpiece 102. As previously described, the track formed by rails 2110, 2210, and 2310, and clamp pieces 2204 and 2304 guide the horizontal movement of hip frames in the direction of arrows C and D. As such, a user may adjust the hip frames to a desired width.

Once the adjustable spine assembly 110 has been adjusted to the desired position, method 3300 may return to operation 3302 to alternate from the first mode to the second mode. Spine cam lever 140 may be placed into the closed position at operation 3302 to operate the assembly 100 in the first mode at operation 3320. As previously described, when transitioning from the open position to the closed position, the distance between dowel pin 142 and slider body 410 may be increased, which causes dowel pin 2900 to move in the direction of arrow C and pull spine clamp piece 420 against base portion 112. As such, a clamping force is applied on the base portion by rail 412 and spine clamp piece 420 to secure and stabilize shoulder brace 114 in the desired position.

In some embodiments, the first mode may also correspond to the placement of hip cam levers 2202 and 2302 of hip adjustment mechanisms to closed positions at operation 3302. As previously described, when hip cam levers 2202 and 2302 are in the closed position, the rotary motions of hip cam levers are transformed into linear motion against the respective hip clamp pieces 2203 and 2304 in the directions of arrows A and B. As such, the hip clamp pieces are urged against the hip frames to secure and stabilize hip frames in the desired position.

Assembly 100 should now be properly fitted to be mounted on the user's torso. In various embodiments, in the second mode, the user may operate the exoskeleton assembly in anyone of the various operational modes previously described.

Once the adjustable spine assembly 110 has been adjusted to the desired position, it may be determined whether further adjustments are desired at 3304. If further adjustments are not desired, method 3300 continues operation in the second mode at 3320 to secure shoulder brace 114 in the desired position. However, if it is determined that adjustments are desired, method 3300 may return to operation 3302 to alternate from the second mode to the first mode.

Because the hip adjustment mechanisms for the right hip frame and the left hip frame may be operated independently from each other, as well as independently from the spine adjustment mechanism, each hip adjustment mechanism may be associated with its own operational modes. For example, the right hip adjustment mechanism may be alternated between a third mode and a fourth mode. The third mode may correspond to right hip cam lever 2202 in the open position and right hip clamp piece 2204 in the unlocked position. The fourth mode may correspond to right hip cam lever 2202 in the closed position and right hip clamp piece 2204 in the locked position. The left hip adjustment mechanism may be alternated between a fifth mode and a sixth mode. The fifth mode may correspond to left hip cam lever 2302 in the open position and left hip clamp piece 2304 in the unlocked position. The sixth mode may correspond to left hip cam lever 2302 in the closed position and left hip clamp piece 2304 in the locked position. It should be understood that any combination of the aforementioned modes may be implemented at any one time. In some embodiments, the alternating between the modes of each adjustment mechanism may occur individually or simultaneously.

Leg Adjustment Mechanism

Figure 34:
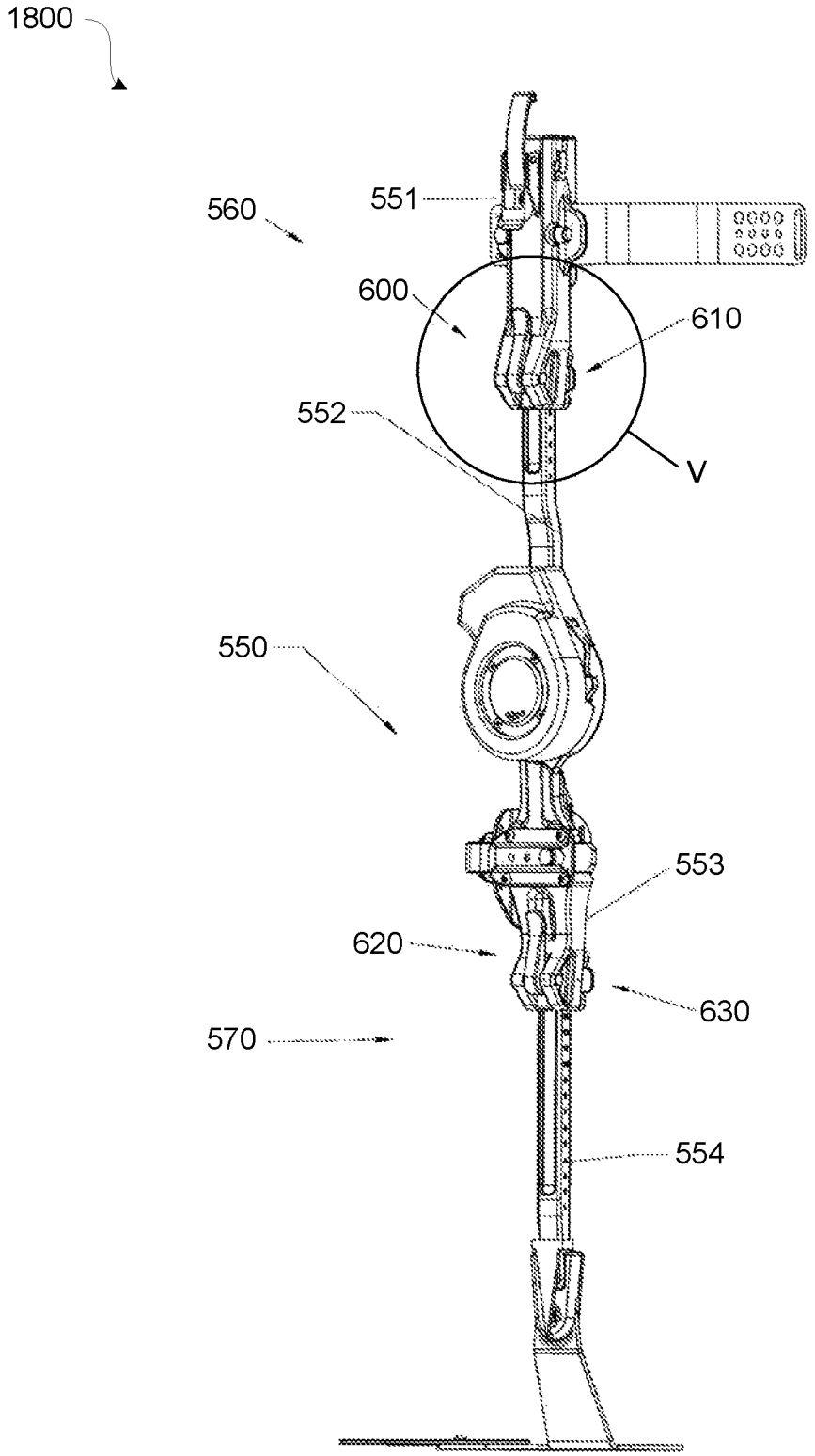
FIG. 34 illustrates a perspective view of an adjustable leg assembly of an exoskeleton apparatus, in accordance with one or more embodiments.

In various embodiments, the exoskeleton assembly may further comprise adjustable leg assemblies, such as leg assemblies 1800. FIG. 34 illustrates a perspective view of an adjustable leg assembly 1800 of an exoskeleton apparatus, in accordance with one or more embodiments. The exoskeleton leg assembly 1800 comprises an adjustable thigh assembly 560, a knee joint 550, and an adjustable shank assembly 570. In various embodiments, the thigh assembly 560 is configured to be coupled to the user's thigh, and shank assembly 570 is configured to be coupled to the user's shank. The thigh assembly is further configured to move in unison with the wearer's thigh and the shank assembly is configured to move in unison with the wearer's shank.

Thigh assembly 560 may comprise upper thigh member 551, lower thigh member 552, first locking mechanism 600, and second locking mechanism 610. Shank assembly 570 may comprise upper shank member 553, lower shank member 554, first locking mechanism 620, and second locking mechanism 630.

In some embodiments, thigh assembly 560 and shank assembly 570 can be adjusted in length to fit the user's lower leg length. The thigh assembly 560 and the shank assembly 570 may each comprise a first locking mechanism and a second locking mechanism to achieve the length change. The length change occurs by relative motion between the upper thigh member 551 and the lower thigh member 552 for the thigh assembly, and between the upper shank member 553 and the lower shank member 554 for the shank assembly.

In various embodiments, the first locking mechanism and the second locking mechanism of the thigh assembly and the shank assembly may be different locking mechanisms. In the embodiments depicted in FIGS. 34-40, the thigh assembly and the shank assembly utilize the same first locking mechanisms and the same second locking mechanisms. Thus, details of first locking mechanism 600 and the second locking mechanism 610 for thigh assembly 560 are described, and apply to first locking mechanism 620 and the second locking mechanism 630, respectively, of shank assembly 570.

Figure 36:
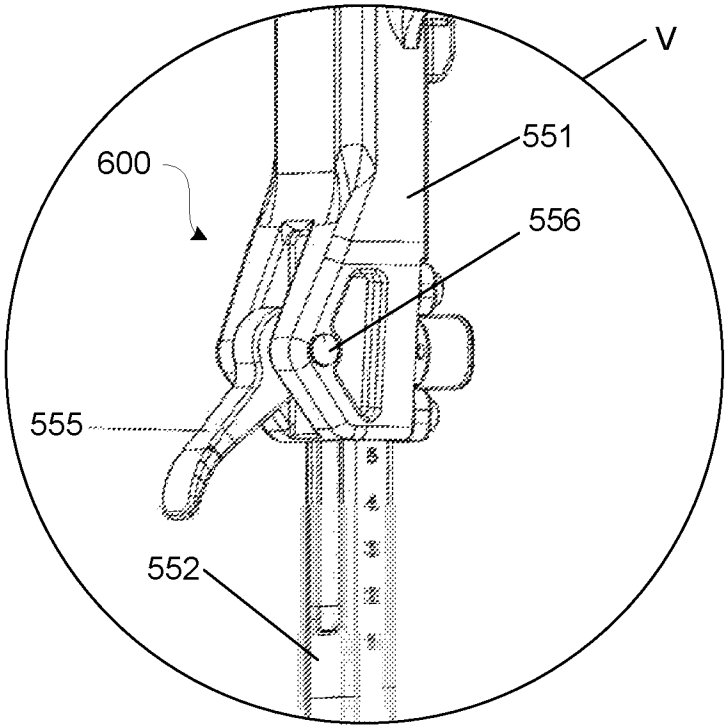
FIG. 36 illustrates an enlarged perspective view of a first locking mechanism of an adjustable leg assembly in an open position, in accordance with one or more embodiments.
Figure 35:
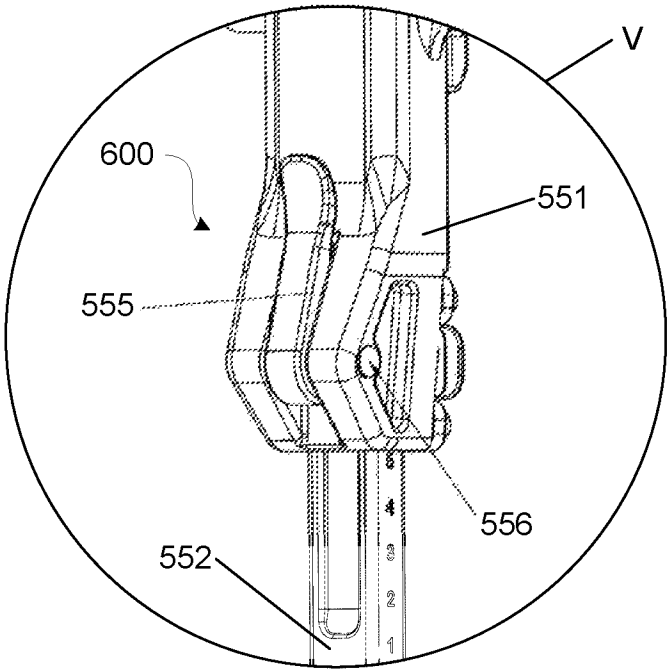
FIG. 35 illustrates an enlarged perspective view of a first locking mechanism of an adjustable leg assembly in a closed position, in accordance with one or more embodiments.
Figure 37:
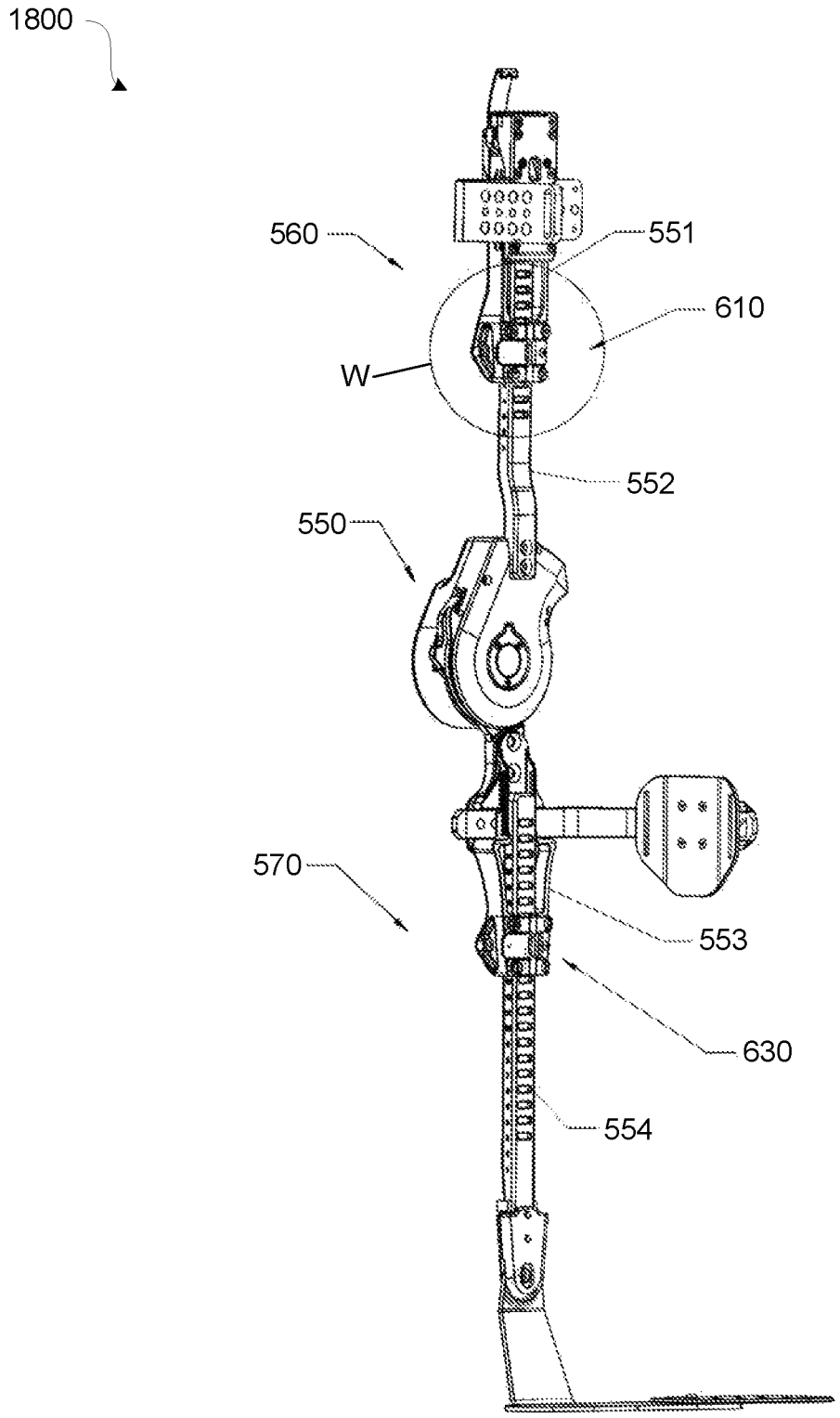
FIG. 37 illustrates another perspective view of the components of an adjustable leg assembly of an exoskeleton apparatus, in accordance with one or more embodiments.
Figure 39:
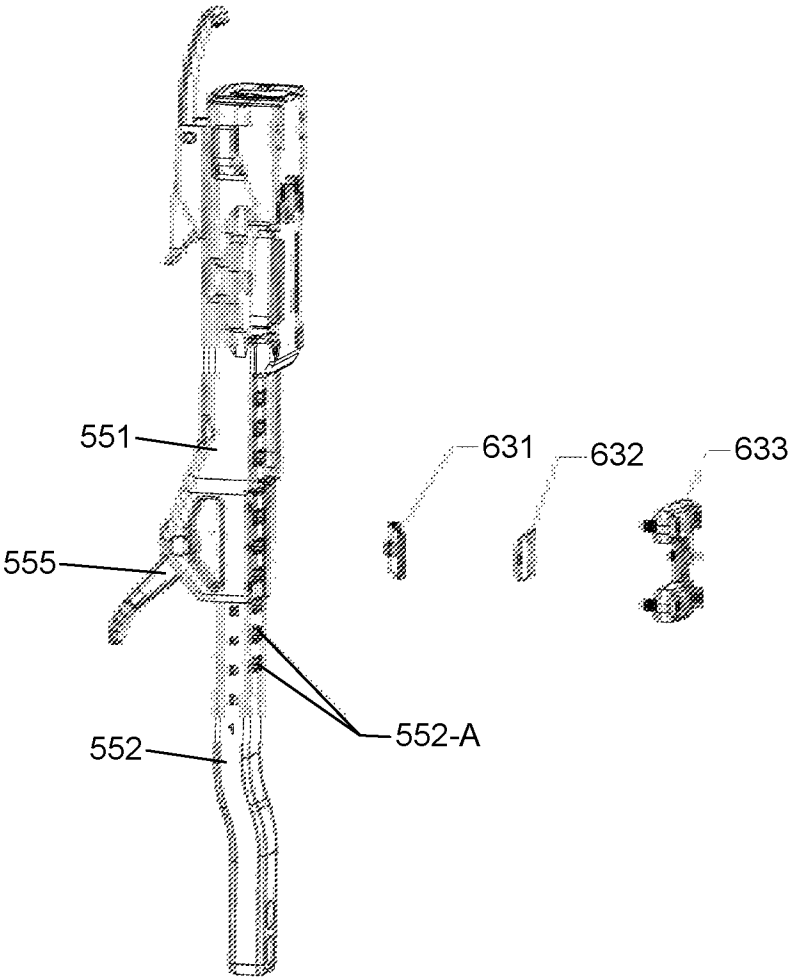
FIG. 39 illustrates various components of a second locking mechanism of an adjustable leg assembly, in accordance with one or more embodiments.
Figure 38:
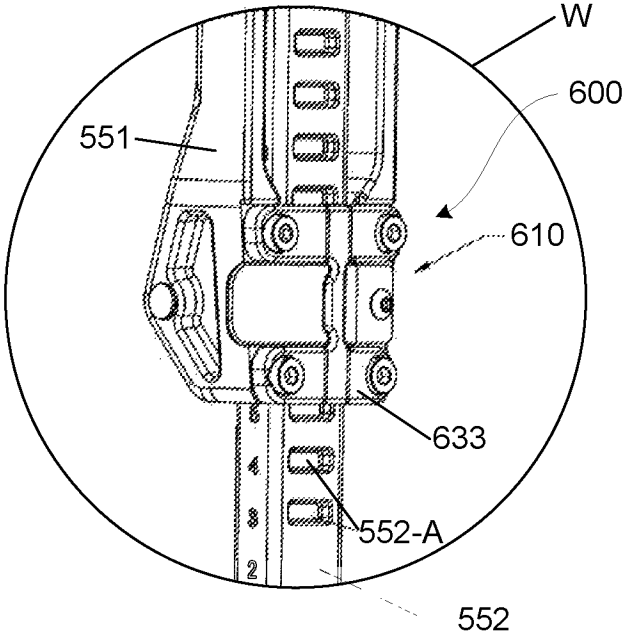
FIG. 38 illustrates an enlarged view of a second locking mechanism of an adjustable leg assembly, in accordance with one or more embodiments.
Figure 40:
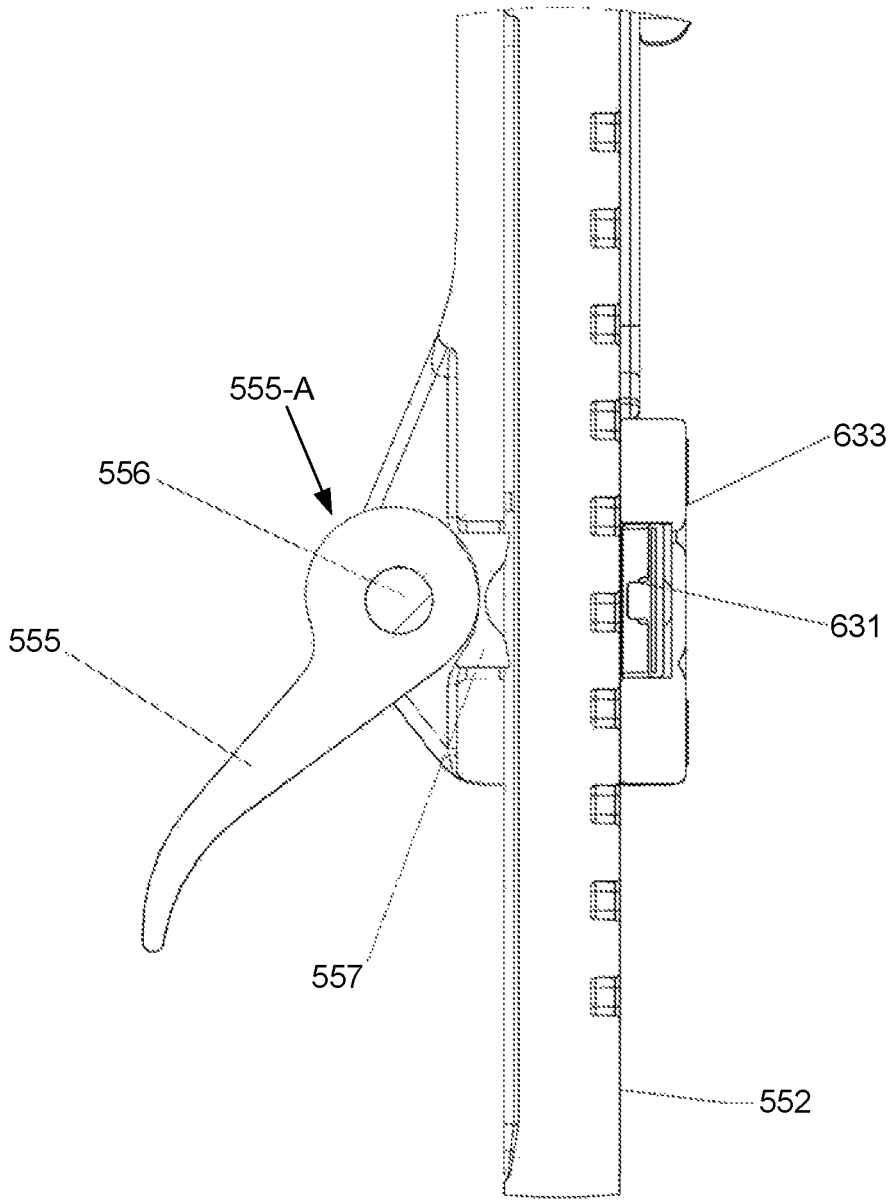
FIG. 40 illustrates a cross-sectional view of the components of an example adjustable leg assembly, in accordance with one or more embodiments.

FIG. 35 illustrates an enlarged perspective view of a first locking mechanism 600 of an adjustable leg assembly in a closed position, in accordance with one or more embodiments. FIG. 36 illustrates an enlarged perspective view of a first locking mechanism 600 of an adjustable leg assembly in an open position, in accordance with one or more embodiments. FIG. 37 illustrates another perspective view of the components of an adjustable leg assembly 1800 of an exoskeleton apparatus, in accordance with one or more embodiments. FIG. 38 illustrates an enlarged view of a second locking mechanism 610 of an adjustable leg assembly 1800, in accordance with one or more embodiments. FIG. 39 illustrates various components of a second locking mechanism 610 of an adjustable leg assembly 1800, in accordance with one or more embodiments. FIG. 40 illustrates a cross-sectional view of the components of an example adjustable leg assembly 1800, in accordance with one or more embodiments.

In various embodiments, first locking mechanism 600 comprises of cam lever 555 rotating about pin 556 coupled to the upper thigh member 551. As depicted in FIGS. 34-36, first locking mechanism 600 further comprises of a compliant element 557 (depicted in FIG. 40). In a locked position, as shown in FIG. 35, cam profile 555-A of cam lever 555 urges compliant element 557 against lower thigh member 552 creating a friction force between compliant element 557 and lower thigh member 552 which prevents relative motion between the lower thigh member 552 and the upper thigh member 551. In the unlocked position, as shown in FIG. 36, cam profile 555-A does not create a friction force between compliant element 557 and lower thigh member 552 allowing motion between the two members, thus permitting length change of the thigh assembly.

As shown in FIGS. 38 and 39, second locking mechanism 610 comprises a set of notches 552-A in lower thigh member 552, thigh indexing pin 631, leaf spring 632 and mechanism holder 633. Thigh indexing pin 631 rotates relative to the mechanism holder 633. In some embodiments, mechanism holder 633 may be fastened to upper thigh member 551.

In the locked position, thigh indexing pin 631 is urged into a notch of the set of notches 552-A in an interlocked position due to a force provided by leaf spring 632. When the thigh indexing pin 631 is interlocked with a notch in the set of notches 552-A, the relative motion between upper thigh member 551 and lower thigh member 552 is restricted. A user may lift thigh indexing pin 631 acting against the leaf spring 632 to release thigh indexing pin 631 from the notch in the set of notches 552-A, to move the second locking mechanism into an unlocked position. In the unlocked position, relative motion between upper thigh member 551 and lower thigh member 552 is possible. It should be noted that with either first or second locking mechanism is in a respective locked position, length change of the thigh assembly is not permissible. The length change is only permissible when both first and second locking mechanism are in the unlocked position. The existence of the two locking mechanism allows for redundancy in the system adding safety. The dual locking mechanisms act as a fail-safe against accidently unlocking of the device or failure of the individual locking mechanism.

Although many of the components and processes are described above in the singular for convenience, it will be appreciated by one of skill in the art that multiple components and repeated processes can also be used to practice the techniques of the present disclosure.

While the disclosure has been particularly shown and described with reference to specific embodiments thereof, it should be appreciated that changes in the form and details of the disclosed embodiments may be made without departing from the spirit or scope of the disclosure. It is therefore intended that the disclosure be interpreted to comprise all variations and equivalents that fall within the true spirit and scope of the present disclosure.

What is claimed is:

1. An exoskeleton hip and trunk assembly comprising:

an adjustable spine comprising:

a base portion;

a shoulder brace slidably coupled to the base portion;

a first locking mechanism configured to alternate between a first locked position and a first unlocked position; and a second locking mechanism configured to alternate between a second locked position and a second unlocked position;

wherein when the first locking mechanism is in the first unlocked position and the second locking mechanism is in the second unlocked position, the shoulder brace and base portion are free to slide relative to each other thereby adjusting a length of the adjustable spine; and wherein when either the first locking mechanism is in the first locked position or the second locking mechanism is in the second locked position, the shoulder brace and the base portion are not free to slide relative to each other.

2. The exoskeleton hip and trunk assembly of claim 1, wherein the adjustable spine is configured to be positioned substantially behind a wearer and substantially parallel to a spine of the wearer.

3. The exoskeleton hip and trunk assembly of claim 1, wherein the first locking mechanism comprises:

at least one spine indexing pin coupled to the base portion; and a set of notches coupled to the shoulder brace;

wherein when the first locking mechanism is in the first locked position, the at least one spine indexing pin is configured to interlock with a notch of the set of notches in an interlocked position thereby preventing the shoulder brace and the base portion from sliding relative to each other.

4. The exoskeleton hip and trunk assembly of claim 1, wherein the first locking mechanism comprises:

at least one spine indexing pin coupled to the shoulder brace; and a set of notches coupled to the base portion;

wherein when the first locking mechanism is in the first locked position, the at least one spine indexing pin is configured to interlock with a notch of the set of notches in an interlocked position thereby preventing the shoulder brace and the base portion from sliding relative to each other.

5. The exoskeleton hip and trunk assembly of claim 4, wherein the first locking mechanism further comprises a spring mechanism configured to urge the at least one spine indexing pin into the interlocked position when the first locking mechanism is in the first locked position.

6. The exoskeleton hip and trunk assembly of claim 4, wherein when the first locking mechanism is in the first unlocked position, the at least one spine indexing pin is moved out of the interlocked position.

7. The exoskeleton hip and trunk assembly of claim 1, wherein the second locking mechanism comprises a spine clamp piece coupled to a spine cam lever;

wherein the spine cam lever and the spine clamp piece are configured to create a friction force between the base portion and the shoulder brace thereby preventing the shoulder brace and the base portion from sliding relative to each other when the second locking mechanism is in the second locked position.

8. An exoskeleton hip and trunk assembly comprising:

a centerpiece;

a first hip frame extending from a first side of the centerpiece; and a first locking mechanism configured to alternate between a first locked position and a first unlocked position; and a second locking mechanism, configured to alternate between a second locked position and a second unlocked position;

wherein when the first locking mechanism is in the first unlocked position and the second locking mechanism is in the second unlocked position, the first hip frame is free to slide relative to the centerpiece thereby adjusting a width of the exoskeleton hip and trunk assembly; and wherein when either the first locking mechanism is in the first locked position or the second locking mechanism is in the second locked position, the first hip frame and the centerpiece are not free to slide relative to each other.

9. The exoskeleton hip and trunk assembly of claim 8, wherein the first locking mechanism comprises:

a hip indexing pin coupled to the centerpiece; and a set of notches coupled to the first hip frame;

wherein when the first locking mechanism is in the first locked position, the hip indexing pin is configured to interlock with a notch of the set of notches in an interlocked position thereby preventing the first hip frame and the centerpiece from sliding relative to each other.

10. The exoskeleton hip and trunk assembly of claim 9, wherein the first locking mechanism further comprises a spring mechanism configured to urge the hip indexing pin into the interlocked position when the first locking mechanism is in the first locked position.

11. The exoskeleton hip and trunk assembly of claim 9, wherein when the first locking mechanism is moved to the first unlocked position, the hip indexing pin is moved out of the interlocked position.

12. The exoskeleton hip and trunk assembly of claim 8, wherein the second locking mechanism comprises a hip clamp piece coupled to a hip cam lever;

wherein the hip cam lever and the hip clamp piece are configured to create a friction force between the first hip frame and the centerpiece thereby preventing the first hip frame and the centerpiece from sliding relative to each other when the second locking mechanism is in the second locked position.

13. The exoskeleton hip and trunk assembly of claim 8, further comprising a leg assembly extending from the first hip frame, wherein the leg assembly comprises:

an adjustable thigh assembly, and an adjustable shank assembly.

14. The exoskeleton hip and trunk assembly of claim 13, wherein the adjustable thigh assembly is configured to be coupled to a thigh of a wearer and to move in unison with the thigh; and wherein the adjustable shank assembly is configured to be coupled to a shank of the wearer and to move in unison with the shank.

15. The exoskeleton hip and trunk assembly of claim 13, wherein the adjustable thigh assembly comprises:

an upper thigh member slidably coupled to a lower thigh member;

a third locking mechanism configured to alternate between a third locked position and a third unlocked position; and a fourth locking mechanism configured to alternate between a fourth locked position and a fourth unlocked position;

wherein when the third locking mechanism is in the third unlocked position and the fourth locking mechanism is in the fourth unlocked position, the upper thigh member and the lower thigh member are free to slide relative to each other thereby adjusting a length of the adjustable thigh assembly; and wherein when either the third locking mechanism is in the third locked position or the fourth locking mechanism is in the fourth locked position, the upper thigh member and the lower thigh member are not free to slide relative to each other.

16. The exoskeleton hip and trunk assembly of claim 15, wherein the adjustable shank assembly comprises:

an upper shank member slidably coupled to a lower shank member;

a fifth locking mechanism configured to alternate between a fifth locked position and a fifth unlocked position; and a sixth locking mechanism configured to alternate between a sixth locked position and a sixth unlocked position;

wherein when the fifth locking mechanism is in the fifth unlocked position and the sixth locking mechanism is in the sixth unlocked position, the upper shank member and the lower shank member are free to slide relative to each other thereby adjusting a length of the adjustable shank assembly; and wherein when either the fifth locking mechanism is in the fifth locked position or the sixth locking mechanism is in the sixth locked position, the upper shank member and the lower shank member are not free to slide relative to each other.

17. The exoskeleton hip and trunk assembly of claim 8, wherein the centerpiece is configured to be positioned substantially behind a pelvis of a wearer.

18. An exoskeleton assembly configured to be coupled to a wearer, the exoskeleton assembly having a plurality of members moving in unison with corresponding body segments of the wearer, wherein a first member is adjustable in length and comprises:

a first component substantially parallel to a body segment;

a second component substantially parallel to the body segment;

a first locking mechanism configured to alternate between a first locked position and a first unlocked position; and a second locking mechanism configured to alternate between a second locked position and second unlocked position;

wherein when the first locking mechanism is in the first unlocked position and the second locking mechanism is in the second unlocked position, the first component and the second component are free to slide relative to each other thereby adjusting a length of the first member; and wherein when either the first locking mechanism is in the first locked position or the second locking mechanism is in the second locked position, the first component and the second component are not free to slide relative to each other.

19. The exoskeleton assembly of claim 18, wherein the first locking mechanism comprises:

at least one indexing pin coupled to the first component; and a set of notches coupled to the second component;

wherein when the first locking mechanism is in the first locked position, the at least one indexing pin is configured to interlock with a notch of the set of notches in an interlocked position.

20. The exoskeleton assembly of claim 19, wherein the first locking mechanism further comprises a spring mechanism configured to urge the at least one indexing pin into the interlocked position when the first locking mechanism is in the first locked position.

21. The exoskeleton assembly of claim 19, wherein when the first locking mechanism is in the first unlocked position, the at least one indexing pin is moved out of the interlocked position.

22. The exoskeleton assembly of claim 18, wherein the second locking mechanism comprises a clamp piece coupled to a cam lever;

wherein the cam lever and the clamp piece are configured to create a friction force between the first component and the second component thereby preventing the first component and the second component from sliding relative to each other when the second locking mechanism is in the second locked position.

23. A system comprising:

a controller;

a power source; and a torso assembly comprising:

a centerpiece;

an adjustable spine assembly extending vertically from the centerpiece, wherein the adjustable spine assembly comprises:

a base portion including a first set of notches; and a shoulder brace slidably coupled to the base portion;

a first adjustment mechanism configured to:

allow the shoulder brace to slide along the base portion when in a first mode and interlock with a notch of the first set of notches to secure the shoulder brace upon the base portion when in a second mode;

a first hip frame coupled to the centerpiece at a first end of the first hip frame and extending laterally from a first side of the centerpiece; and a second hip frame coupled to the centerpiece at a first end of the second hip frame and extending laterally from a second side of the centerpiece.

24. The system of claim 23, wherein the first adjustment mechanism comprises:

an indexing pin configured to interlock with the first set of notches; and a clamping piece coupled to a cam lever;

wherein the cam lever and the clamping piece are configured to create friction against the base portion of the adjustable spine assembly.

25. The system of claim 24 further comprising a second adjustment mechanism configured to:

allow the first hip frame to slide laterally relative to the centerpiece when in a third mode, and interlock with a notch of a second set of notches located on the first hip frame to secure the first hip frame upon the centerpiece when in a fourth mode.

26. The system of claim 25 further comprising a third adjustment mechanism configured to:

allow the second hip frame to slide laterally relative to the centerpiece when in a fifth mode, and interlock with a notch of a third set of notches located on the second hip frame to secure the second hip frame upon the centerpiece when in a sixth mode.

27. The system of claim 23, further comprising:

a first motor mount located at a second end of the first hip frame;

a first motor assembly coupled to the first motor mount;

a second motor mount located at a second end of the second hip frame; and a second motor assembly coupled to the second motor mount.

28. The system of claim 23 further comprising one or more lights capable of emitting one or more colors of light.

29. The system of claim 28, wherein each of the one or more colors of light corresponds to an operational state of the system.

30. The system of claim 29, wherein the operational state includes one of the following: a standing state, a walking state, and a seated state.

* * * * *